US011855345B2

(12) United States Patent
Gunnels

(10) Patent No.: US 11,855,345 B2
(45) Date of Patent: Dec. 26, 2023

(54) THIN METAL VIVALDI ANTENNA SYSTEMS

(71) Applicant: PCTEL, Inc., Bloomingdale, IL (US)

(72) Inventor: Robert Gunnels, Homer Glen, IL (US)

(73) Assignee: PCTEL, INC., Bloomingdale, IL (US)

( * ) Notice: Subject to any disclaimer, the term of this patent is extended or adjusted under 35 U.S.C. 154(b) by 0 days.

(21) Appl. No.: 17/522,604

(22) Filed: Nov. 9, 2021

(65) Prior Publication Data

US 2023/0143858 A1 May 11, 2023

(51) Int. Cl.
*H01Q 21/24* (2006.01)
*H01Q 13/08* (2006.01)

(52) U.S. Cl.
CPC ..... *H01Q 13/085* (2013.01); *H01Q 21/24* (2013.01)

(58) Field of Classification Search
CPC ..... H01Q 13/085; H01Q 21/24
See application file for complete search history.

(56) References Cited

U.S. PATENT DOCUMENTS 6,191,750 B1 * 2/2001 Bonebright ..... H01Q 13/085 343/700 MS
7,064,722 B1 * 6/2006 Neel ..... H01Q 13/085 343/770
10,847,898 B2 * 11/2020 Rowell ..... G01J 4/04
11,043,747 B2 * 6/2021 Mancewicz ..... H01Q 13/085
2014/0333497 A1 * 11/2014 Cooper ..... H01Q 19/062 343/753
2016/0344104 A1 * 11/2016 Junttila ..... H01Q 13/085

FOREIGN PATENT DOCUMENTS

CN 102709683 A * 10/2012
CN 208489352 U * 2/2019
CN 111490342 A 8/2020
CN 113054424 A * 6/2021

OTHER PUBLICATIONS

H. Feng, F. Zhang and H. Zhang, "A Dual Polarized Vivaldi Antenna with the Notched Band by Feed Line Filter on Conductive Plane," 2018 International Conference on Microwave and Millimeter Wave Technology (ICMMT), 2018, pp. 1-3, doi: 10.1109/ICMMT.2018.8563798. (Year: 2018).*
Broadband Horn Antennas, NSI-MI Technologies, https://www.nsi-mi.com/products/antenna-products/broadband-horn-antenna.
(Continued)

*Primary Examiner* — Dameon E Levi
*Assistant Examiner* — Anh N Ho
(74) *Attorney, Agent, or Firm* — Husch Blackwell LLP

(57) ABSTRACT

An antenna system is provided. Such antenna system includes a first Vivaldi antenna element positioned in a first plane and including first and second radiating elements and a first slot disposed between the first and second radiating elements. The antenna system also includes a first signal feed electrically coupled across the first slot at a first location and a first conductive strip positioned in a second plane offset from and parallel to the first plane. The first conductive strip is positioned in the second plane such that a first longitudinal axis of the first conductive strip runs parallel to a first central axis of the first slot.

7 Claims, 16 Drawing Sheets

(56) References Cited

OTHER PUBLICATIONS

C-93076A Dual Polarized Vivaldi Antenna, Concentric Technology Solutions, Inc., https://ctscorp-usa.com/products/tc-93076a-dual-polarized-vivaldi-antenna/.
Zhang, Y. et al, "Miniaturized Vivaldi Antenna Based on Low Frequency Resonance for WLAN Application," 2017 IEEE International Symposium on Antennas and Propagation & USNC/URSI National Radio Science Meeting, IEEE Jul. 9, 2017, pp. 2007-2008. DOI: 10.1109/APUSNCURSINRSM.2017.8073046.
Extended European Search Report re application No. EP 22204366.3, dated Mar. 24, 2023.

* cited by examiner

THIN METAL VIVALDI ANTENNA SYSTEMS

FIELD

The present invention generally relates to radio frequency (RF) communications hardware. More particularly, the present invention relates to single and dual polarized thin metal Vivaldi antenna systems.

BACKGROUND

Vivaldi type antennas are known in the art. For example, Vivaldi antennas have been around since at least 1979. See Peter J. Gibson: *The Vivaldi Aerial, 9th European Microwave Conference Proceedings*, Brighton, 1979, p. 101-105. A Vivaldi antenna is generally a co-planer broadband slot type antenna where the slot comprises the antenna element and is tapered canonically. Typically, a Vivaldi antenna includes co-planar sheets of metal with a printed circuit board and have a feeding line coupled thereto. Such antennas can be used to both broadcast and receive radio frequency signals. It is desired that such antennas work over a wide frequency range.

Typically, such antennas require a large amount of capacitance between opposing conductors in order to achieve a favorable impedance match when used over a large bandwidth. Currently known Vivaldi antenna designs utilize thick machined metal plates that provide sufficient opposing surface areas to increase capacitance. However, this approach is not only expensive but imparts a large weight to the structure. Furthermore, Vivaldi antennas can be constructed on printed circuit boards from thin metal plating on the surface(s). This printed circuit board construction of Vivaldi antennas typically include very close spacing between the opposing halves of the antenna to establish sufficient capacitance between the two halves of the Vivaldi antenna. This small gap construction typically precludes introduction of a second orthogonal polarization with a common axis.

Similarly, Antipodal Vivaldi antennas achieve higher capacitance between the opposing conductors in the launching region by placing the conductors opposite one another, such as on a printed circuit board. Antipodal Vivaldi antennas also have balanced inputs so that some type of balanced to unbalanced transformation is used to reduce common mode currents. Because of this geometry about the center axis of the antipodal Vivaldi antenna, a dual polarized configuration with a common axis and printed circuit construction is also not possible.

In view of the above, there is a continuing, ongoing need for improved antenna systems that can operate over a wide frequency range. There is also a need for such antennas to be formed of thin plates.

DETAILED DESCRIPTION

Figure 1A:
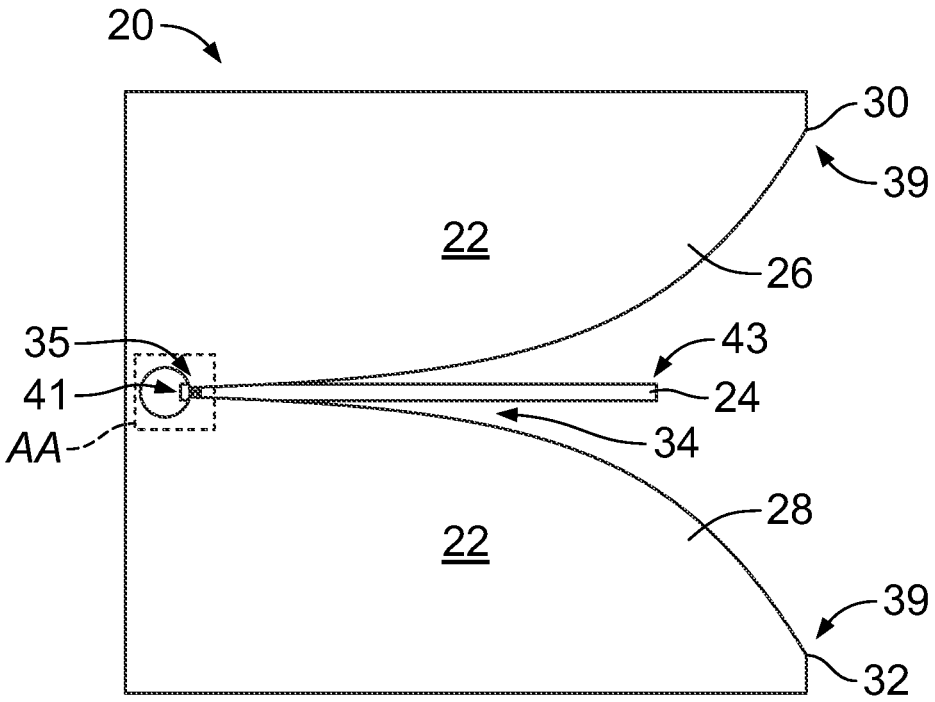
FIG. 1A is an antenna side of the electrical components of a single polarized Vivaldi antenna system according to disclosed embodiments.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Figure 1B:
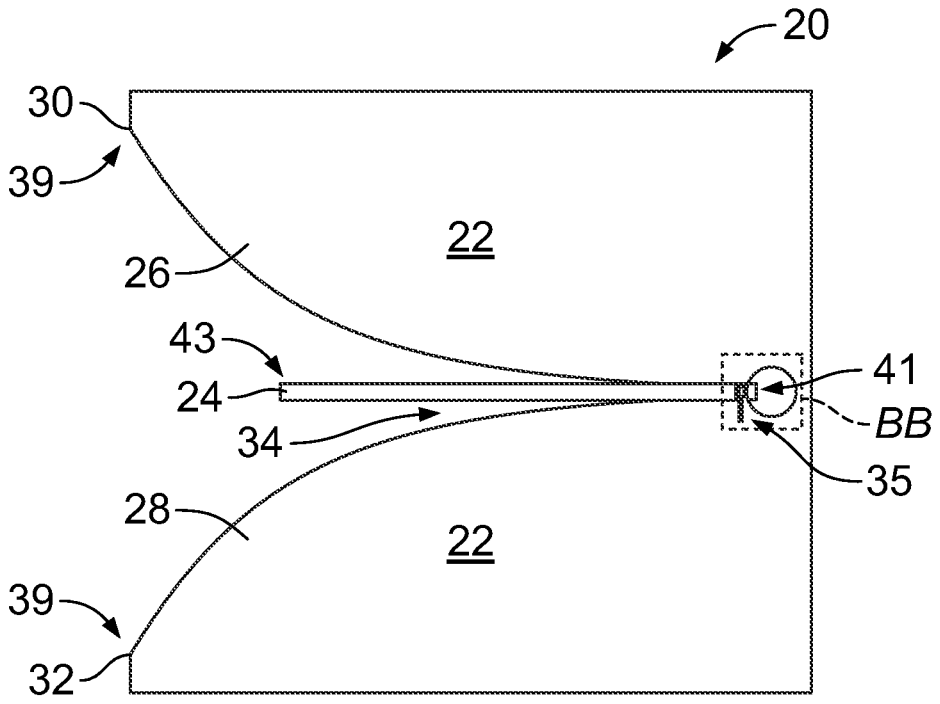
FIG. 1B is a feed side of the electrical components of a single polarized Vivaldi antenna system according to disclosed embodiments.

Embodiments disclosed herein can include single and dual polarized thin metal Vivaldi antenna systems. In particular, such embodiments disclosed herein can include a single polarized Vivaldi antenna system 20 such as shown in FIGS. 1-5. FIG. 1A is an antenna side and FIG. 1B is a feed side showing the electrical components of the single polarized Vivaldi antenna system 20 according to disclosed embodiments. As seen in FIGS. 1A and 1B, the electrical components of the single polarized Vivaldi antenna system 20 can include at least a Vivaldi antenna element 22 positioned in a first plane and a conductive strip 24 positioned in a second plane offset from and parallel to the first plane. As seen in FIGS. 1A and 1B, the Vivaldi antenna element 22 can include a first radiating element 26 and a second radiating element 28 having respective distil ends 30 and 32. In some embodiments, the Vivaldi antenna element 22 can include a slot 34 disposed between the first and second radiating elements 26 and 28. In some embodiments, a longitudinal axis of the conductive strip 24 can run parallel to a central axis of the slot 34.

Furthermore, as seen in FIG. 1A and FIG. 1B, in some embodiments, a width of the slot 34 can increase from a first location 35 to a second location 39 spanning the respective distal ends 30 and 32 of the first and second radiating elements 26 and 28. In some embodiments, the width of the slot 34 can increase at an exponential or approximately exponential rate. Furthermore, in some embodiments, a width of the conductive strip 24 can be wider than a narrowest section of the slot 34 and smaller than a widest section of the slot 34. For example, as seen in FIG. 1A, the Vivaldi antenna element 22 can overlap a portion of the conductive strip 24 at the narrow most section of the slot 34.

Figure 2A:
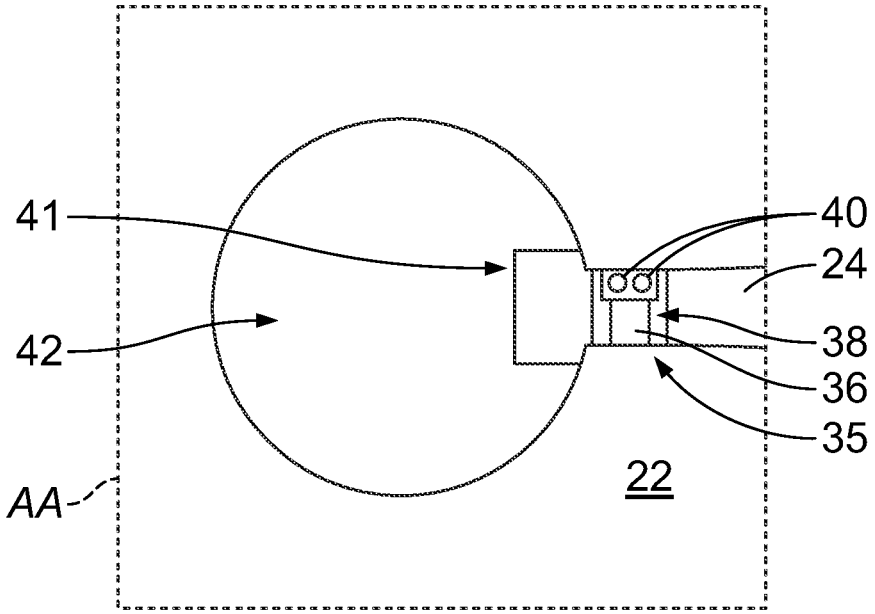
FIG. 2A is a close up of a section of the single polarized Vivaldi antenna system of FIG. 1A.
Figure 2B:
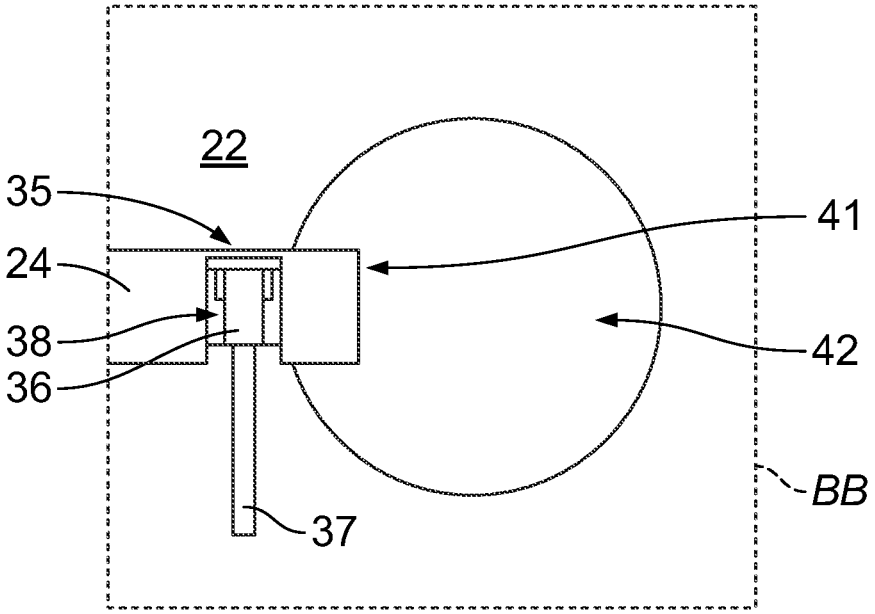
FIG. 2B is a close up of a section of the single polarized Vivaldi antenna system of FIG. 1B.

FIG. 2A and FIG. 2B are respective close ups of sections AA and BB of the single polarized Vivaldi antenna system 20 of FIG. 1A and FIG. 1B, respectively. As seen in FIG. 2A and FIG. 2B, the single polarized Vivaldi antenna system 20 can include a signal feed 36 that can be coupled across the slot 34 at the first location 35 and that in some embodiments can be fed by a microstrip conductor 37 that can be coupled to an external connector such as a coaxial connector. Additionally or alternatively, in some embodiments, the signal feed 36 can be fed by a coaxial cable. Furthermore, in some embodiments, a portion of the signal feed 36 can be positioned in the same plane as the conductive strip 24. In these embodiments, the conductive strip 24 can include an aperture 38 configured to accommodate the portion of the signal feed 36 that is positioned in the same plane as the conductive strip 24. In some embodiments, the signal feed 36 can be electrically coupled to the first Vivaldi antenna element 22 through electrical connections 40. In some embodiments, the electrical connections 40 can pass through one or more through holes in a non-conductive support 44 (see FIGS. 3-5, discussed infra) to which the electrical components of the single polarized Vivaldi antenna system 20 are coupled.

Furthermore, in some embodiments, the first Vivaldi antenna element 22 can include a cutout region 42 that can be sized and shaped to tune one or more radio frequency (RF) characteristics of the single polarized Vivaldi antenna system 20. As seen in FIG. 2A and FIG. 2B, in some embodiments, the first location 35 where the signal feed 36 is coupled across the slot 34 can be located between the cutout region 42 and the second location 39 spanning the respective distal ends 30 and 32 of the first and second radiating elements 26 and 28. Furthermore, in some embodiments, the conductive strip 24 can extend in the second plane from a third location 41 aligned with a portion of the cutout region 42 to a fourth location 43. As seen in FIGS. 1A and 1B, in some embodiments, the fourth location 43 can be located between the first location 35 and the second location 39. However, in some embodiments, the fourth location 43 can be proximate to the second location 39. For example, in some embodiments, the conductive strip 24 can extend all the way to the distal ends 30 and 32.

Figure 3A:
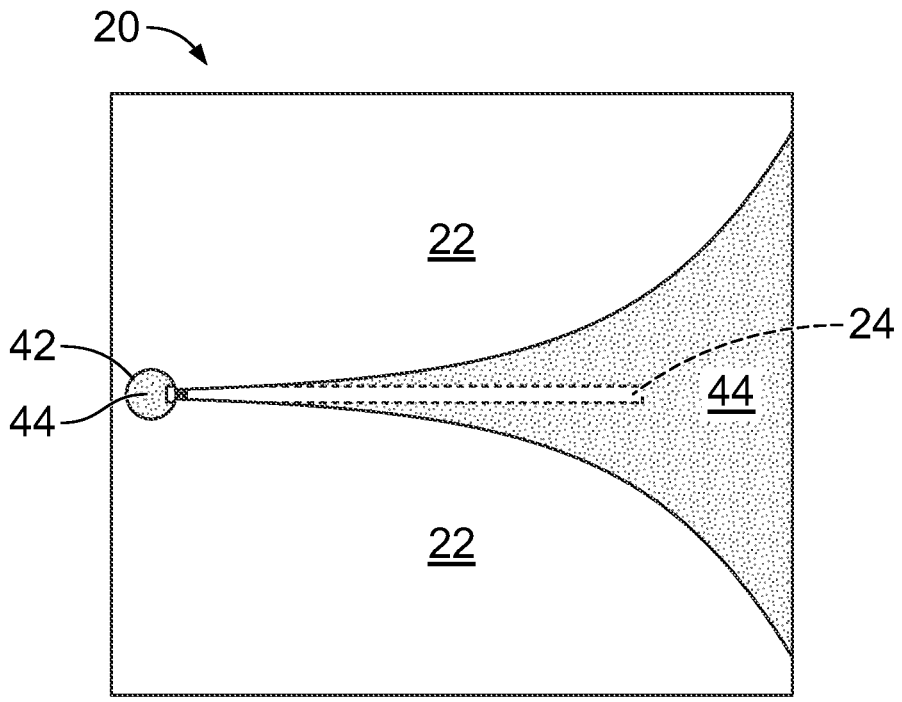
FIG. 3A is an antenna side of a single polarized Vivaldi antenna system with a visually transparent non-conductive support according to disclosed embodiments.
Figure 3B:
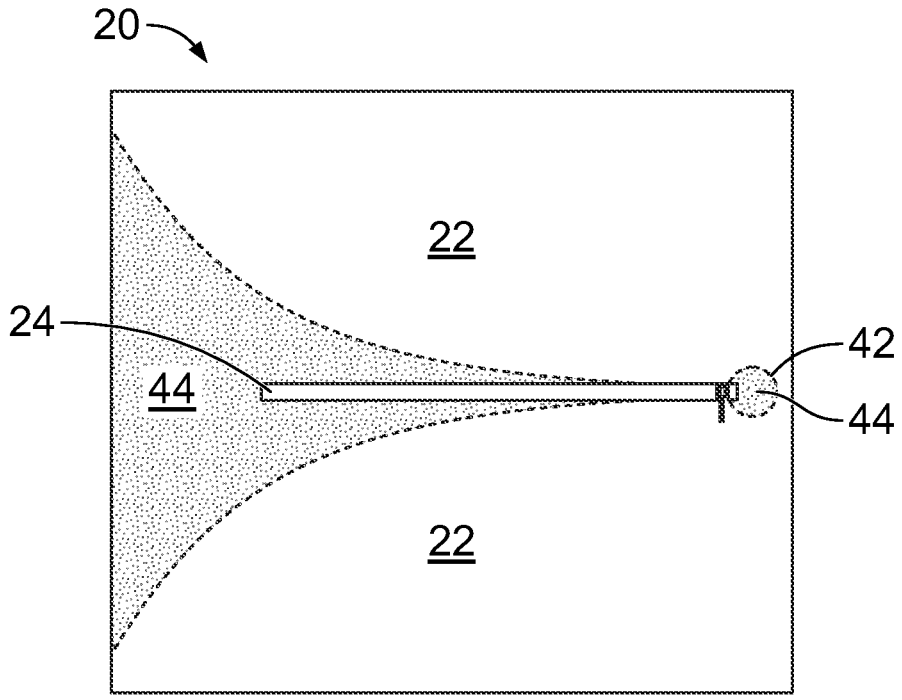
FIG. 3B is a feed side of a single polarized Vivaldi antenna system with a visually transparent non-conductive support according to disclosed embodiments.
Figure 4A:
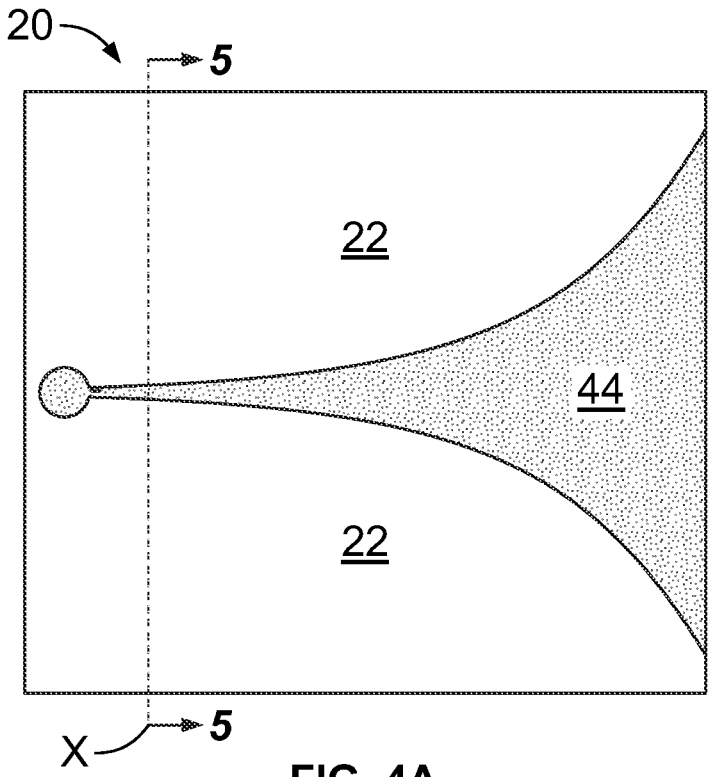
FIG. 4A is an antenna side of a single polarized Vivaldi antenna system with a visually non-transparent non-conductive support according to disclosed embodiments.
Figure 4B:
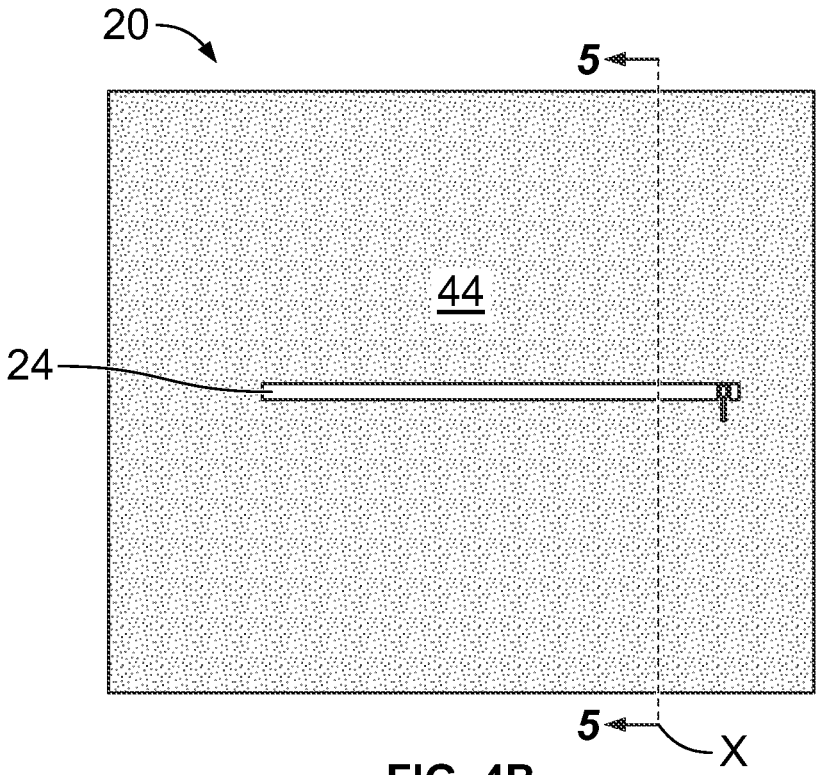
FIG. 4B is a feed side of a single polarized Vivaldi antenna system with a visually non-transparent non-conductive support according to disclosed embodiments.
Figure 5:
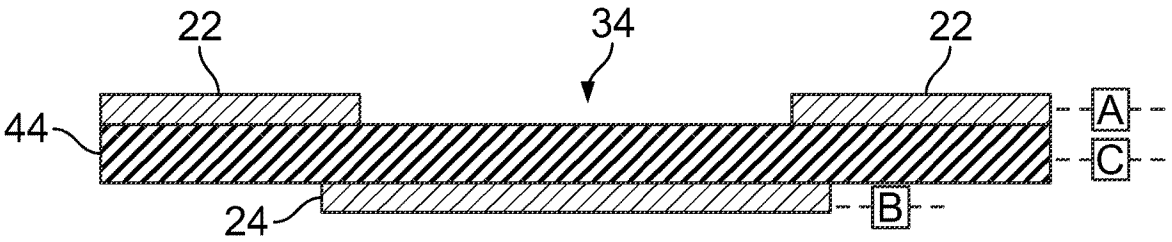
FIG. 5 is a partial cross section along line X of the single polarized Vivaldi antenna system of FIGS. 4A and 4B.

As seen in FIGS. 3-4, in some embodiments, the single polarized Vivaldi antenna system 20 can include a non-conductive support 44. FIGS. 3A and 3B respectively show the antenna side and the feed side of the single polarized Vivaldi antenna system 20 with the non-conductive support 44 being visually transparent to the electrical components. Whereas FIGS. 4A and 4B respectively show the antenna side and the feed side of the single polarized Vivaldi antenna system 20 with the non-conductive support 44 being visually non-transparent to the electrical components. As seen in FIGS. 3-4, in some embodiments, the non-conductive support 44 can be disposed between the first plane in which the Vivaldi antenna element 22 resides and the second plane in which the conductive strip 24 resides. In some embodiments, the Vivaldi antenna element 22 is coupled to a first side of the non-conductive support 44 and the conductive strip 24 is coupled to a second side of the non-conductive support 44 that is opposite the first side. This arrangement can be seen with reference to FIG. 5 which shows a partial cross-section of the single polarized Vivaldi antenna system 20 along the line X shown in FIG. 4A and FIG. 4B. As seen in FIG. 5, in some embodiments, the Vivaldi antenna element 22 can be positioned in a plane A, the conductive strip 24 can be positioned in a plane B, and the non-conductive support 44 can be positioned in a plane C disposed between and parallel to the planes A and B. In some embodiments, a top section of the conductive strip 24 and/or the antenna element 22 can be flush or even with a top section of the non-conductive support 44 such that it would appear as though the conductive strip 24 or the antenna element 22 was embedded in the non-conductive support 44.

In some embodiments, the non-conductive support 44 can include a printed circuit board (PCB) as would be commonly understood to persons having ordinary skill in the art. In some embodiments, the electrical components of the single polarized Vivaldi antenna system 20, including the Vivaldi antenna element 22, the conductive strip 24, and the signal feed 36 can be integrally formed with the PCB using one or more etching procedures known in the art. For example, in some embodiments, the single polarized Vivaldi antenna system 20 can be formed from a dual sided conductive material clad PCB by applying a resist material to sections corresponding to the electrical components and etching away the other portions of the conductive material to reveal the PCB layer underneath (see e.g. the non-conductive support sections 44 in FIG. 4A and FIG. 4B). Additional and alternative constructions methods are also contemplated such as separately forming each of the electrical components of the single polarized Vivaldi antenna system 20 and then joining them to the non-conductive support 44.

In some embodiments, the electrical components of the single polarized Vivaldi antenna system 20, including the Vivaldi antenna element 22, the conductive strip 24, and the signal feed 36, can be manufactured from an electrically conductive material. For example, in some embodiments the electrical components can be made from a metallic material such as copper. In a transmitting operation, the electrical components can be energized by an electrical signal supplied to the single polarized Vivaldi antenna system 20 through the signal feed 36 and can radiate the supplied signal into space over a large bandwidth via the first and second radiating elements 26 and 28. Similarly, in a receiving operation, the radiating elements 26 and 28 can be energized by an ambient RF signal and can route the ambient RF signal to other RF components electrically coupled to the signal feed 36.

Figure 6:
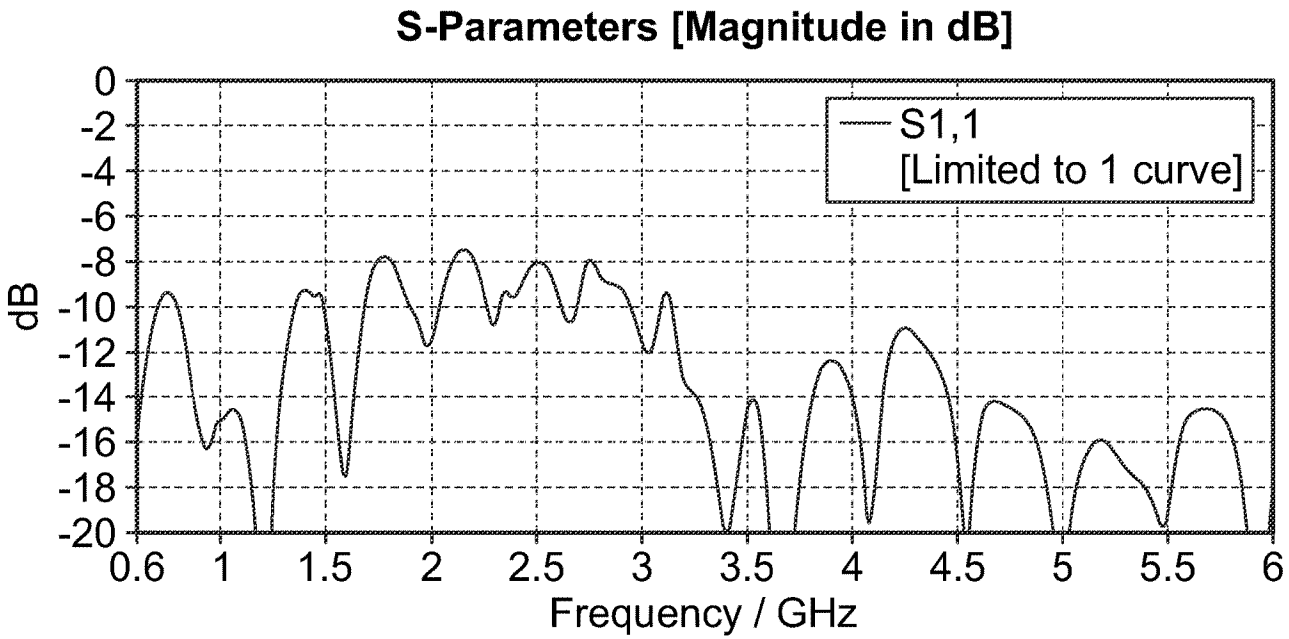
FIG. 6 is a graph of simulated reflection S-parameter magnitude for a single polarized Vivaldi antenna system according to disclosed embodiments.

The configuration of the single polarized Vivaldi antenna system 20 described herein has several advantages over known systems. For example, the placement of the conductive strip 24 on the opposite side of the non-conductive support 44 from the slot 34 can increase the capacitance between the opposing sides of the slot 34 to enable the Vivaldi antenna element 22 to be made from a thin layer of conductive material and for the slot to have a width sufficient for use in alternative arrangement such as a dual polarized system as described herein. The resulting reflection S-parameter magnitude for the single polarized Vivaldi antenna system 20 is shown in FIG. 6.

Figure 7:
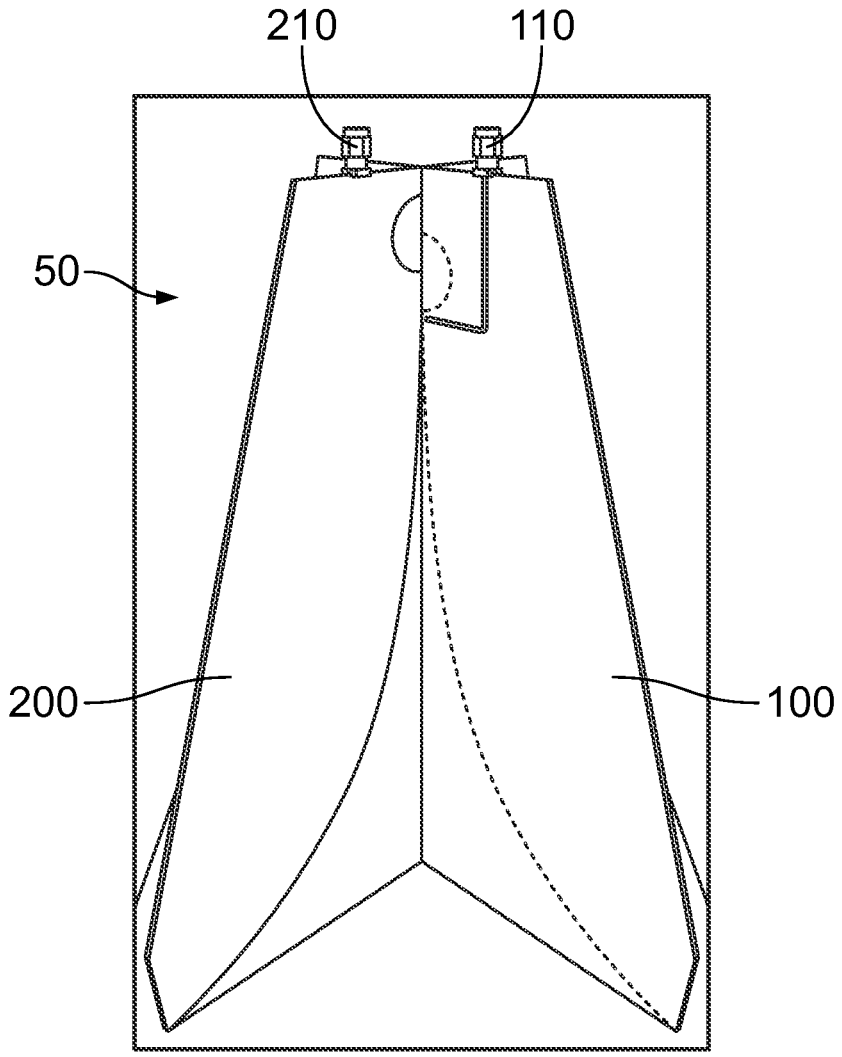
FIG. 7 is a perspective view of a dual polarized Vivaldi antenna system according to disclosed embodiments.

Embodiments disclosed herein can also include a dual polarized Vivaldi antenna system 50 such as shown in FIGS. 7-17. As seen in FIG. 7, the dual polarized Vivaldi antenna system 50 can include a first antenna module 100 and a second antenna module 200 coupled together at approximately a 90 degree angle. As seen in FIG. 7, in some embodiments, the first antenna module 100 and the second antenna modules 200 can respectively include external connectors 110 and 210 for electrically coupling the dual polarized Vivaldi antenna system 50 to other RF equipment known in the art. In some embodiments, the external connectors 110 and 210 can include coaxial connectors.

Figure 8B:
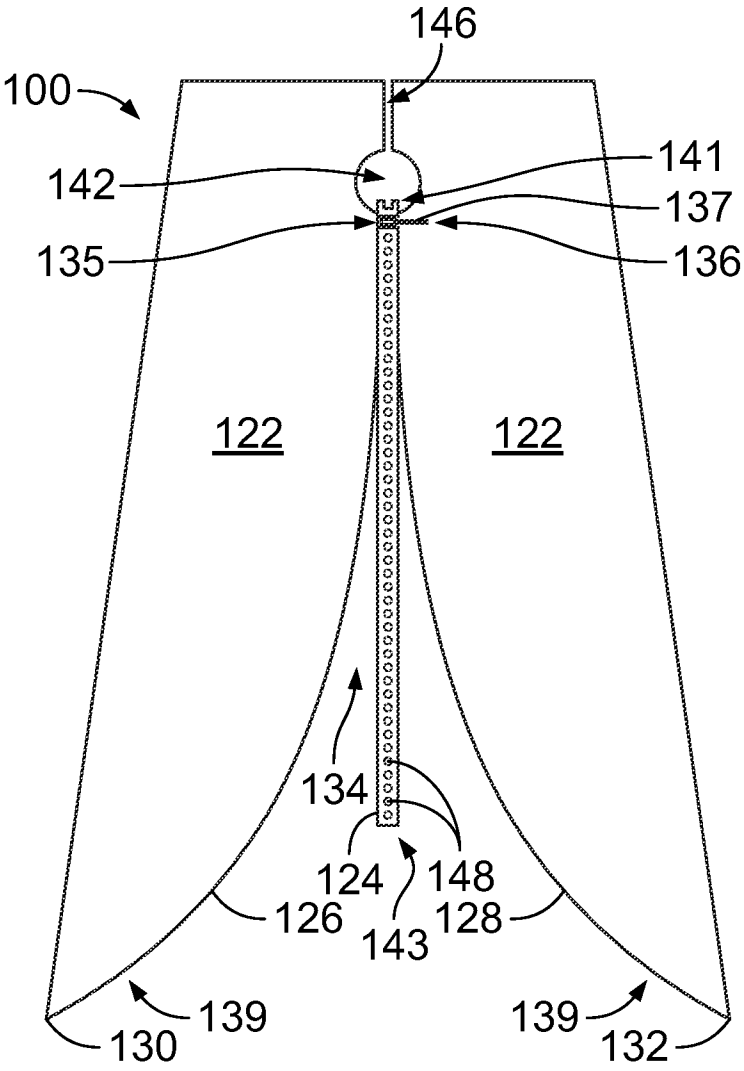
FIG. 8B is a feed side of the electrical components of a first module of a dual polarized Vivaldi antenna system according to disclosed embodiments.
Figure 8A:
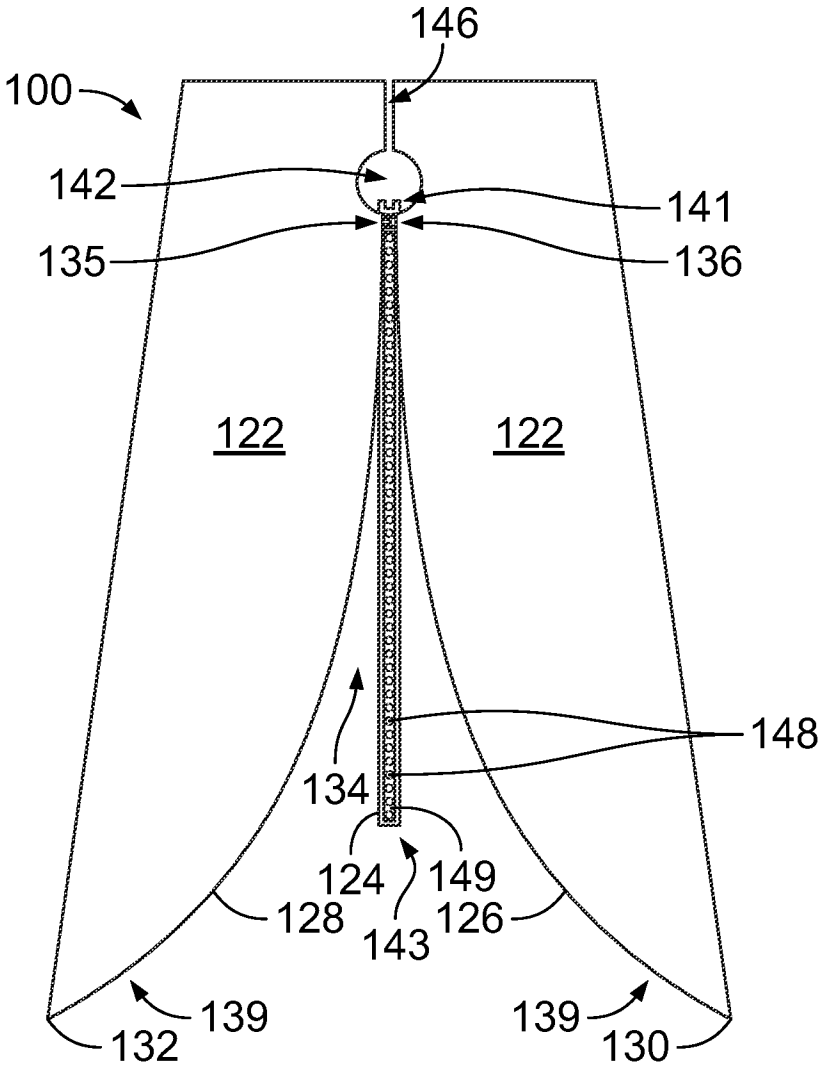
FIG. 8A is an antenna side of the electrical components of a first module of a dual polarized Vivaldi antenna system according to disclosed embodiments.

FIG. 8A is an antenna side and FIG. 8B is a feed side showing the electrical components of the first antenna module 100 according to disclosed embodiments. As seen in FIGS. 8A and 8B, the electrical components of first antenna module 100 can include at least a first Vivaldi antenna element 122 positioned in a first plane and a first conductive strip 124 positioned in a second plane offset from and parallel to the first plane. As seen in FIGS. 8A and 8B, the Vivaldi antenna element 122 can include a first radiating element 126 and a second radiating element 128 having respective distil ends 130 and 132. In some embodiments, the Vivaldi antenna element 122 can include a first slot 134 disposed between the first and second radiating elements 126 and 128. In some embodiments, a longitudinal axis of the first conductive strip 124 can run parallel to a central axis of the first slot 134. Furthermore, in some embodiments, the first antenna module 100 can include a first notch 146 configured to receive a portion of the second antenna module 200. Further still, in some embodiments, the first antenna module 100 can include a plurality of through holes 148 disposed on and passing through the conductive strip 124. As seen in FIG. 8A and FIG. 8B, the first antenna module 100 can also include a first signal feed 136 that can be coupled across the first slot 134 at a first location 135 and that, in some embodiments, can be fed by a first microstrip conductor 137 that can be coupled to the external connector 110 shown in FIG. 7. Additionally or alternatively, in some embodiments, the first signal feed 136 can be fed by a coaxial cable.

Furthermore, as seen in FIG. 8A and FIG. 8B, in some embodiments a width of the first slot 134 can increase from the first location 135 to a second location 139 spanning the respective distal ends 130 and 132 of the first and second radiating elements 126 and 128. In some embodiments, the width of the first slot 134 can increase at an exponential or approximately exponential rate. Furthermore, in some embodiments, a width of the first conductive strip 124 can be wider than a narrowest section of the first slot 134 and smaller than a widest section of the first slot 134. For example, as seen in FIG. 8A the first Vivaldi antenna element 122 can overlap a portion of the first conductive strip 124 at the narrow most section of the first slot 134.

Furthermore, in some embodiments, the first Vivaldi antenna element 122 can include a first cutout region 142 that can be sized and shaped to tune one or more RF characteristics of the dual polarized Vivaldi antenna system 50. As seen in FIG. 8A and FIG. 8B, in some embodiments, the first location 135 where the signal feed 136 is coupled across the first slot 134 can be located between the first cutout region 142 and the second location 139 spanning the respective distal ends 130 and 132 of the first and second radiating elements 126 and 128. Furthermore, in some embodiments, the first conductive strip 124 can extend in the second plane from a third location 141 aligned with a portion of the first cutout region 142 to a fourth location 143. In some embodiments, the fourth location 143 can located between the first location 135 and the second location 139. However, in some embodiments, the fourth location 143 can be proximate to the second location 139. For example, in some embodiments, the first conductive strip 124 can extend all the way to the distal ends 130 and 132.

Figure 9B:
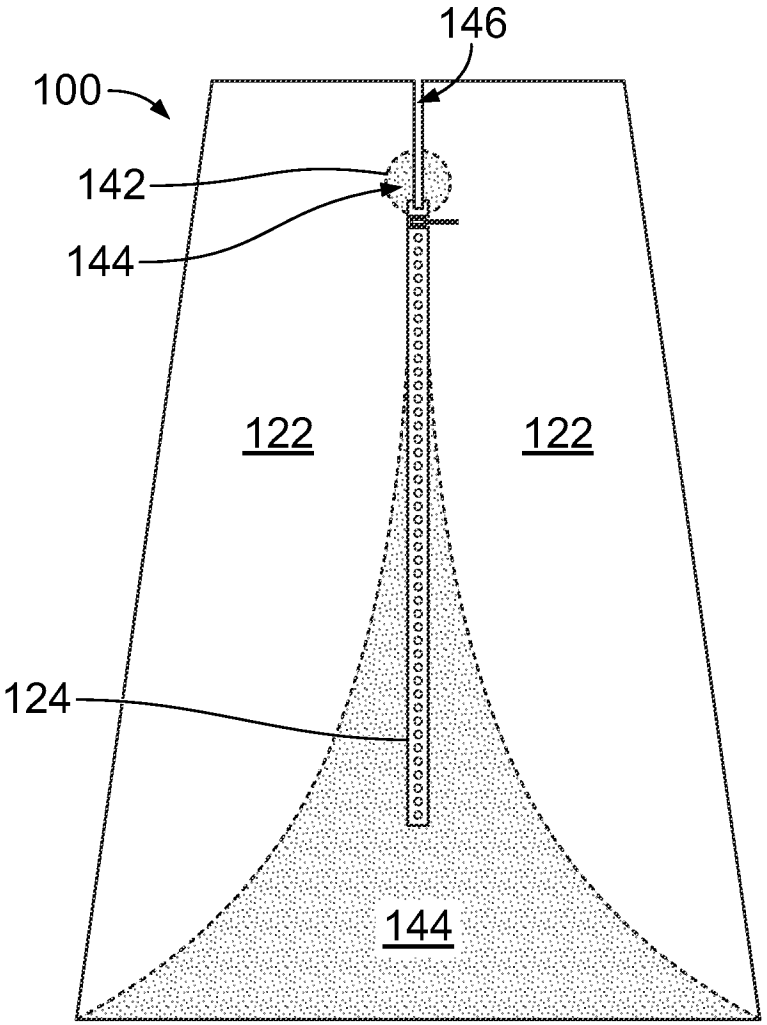
FIG. 9B is a feed side of a first module of a dual polarized Vivaldi antenna system with a visually transparent non-conductive support according to disclosed embodiments.
Figure 9A:
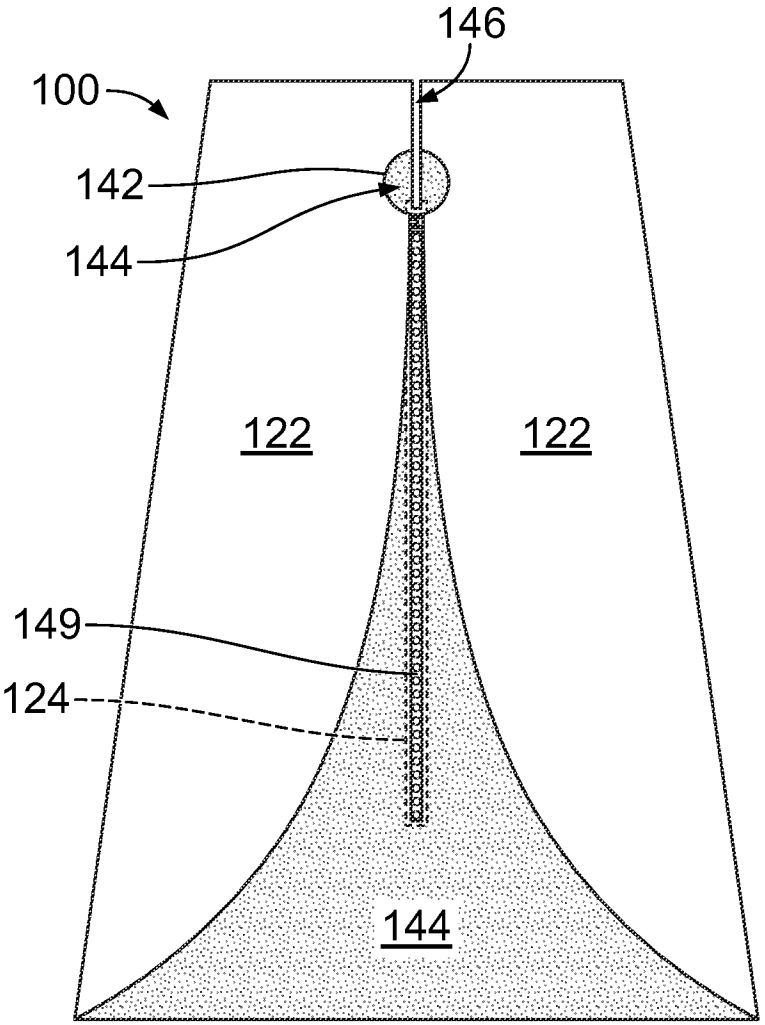
FIG. 9A is an antenna side of a first module of a dual polarized Vivaldi antenna system with a visually transparent non-conductive support according to disclosed embodiments.
Figure 10B:
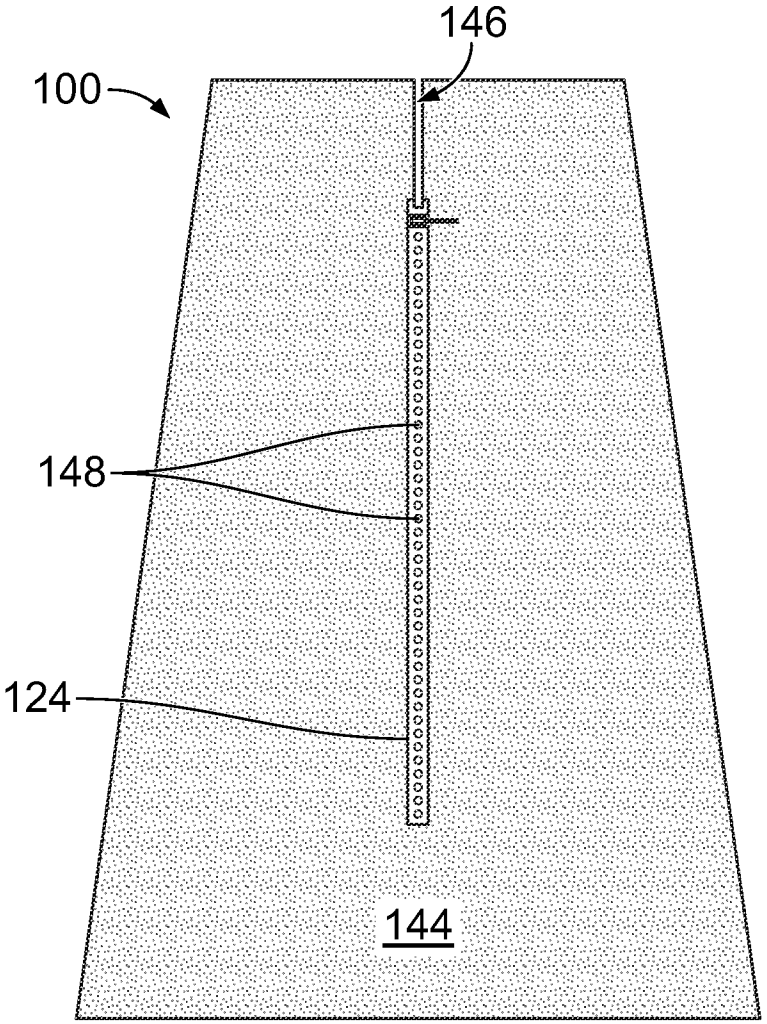
FIG. 10B is a feed side of a first module of a dual polarized Vivaldi antenna system with a visually non-transparent non-conductive support according to disclosed embodiments.
Figure 10A:
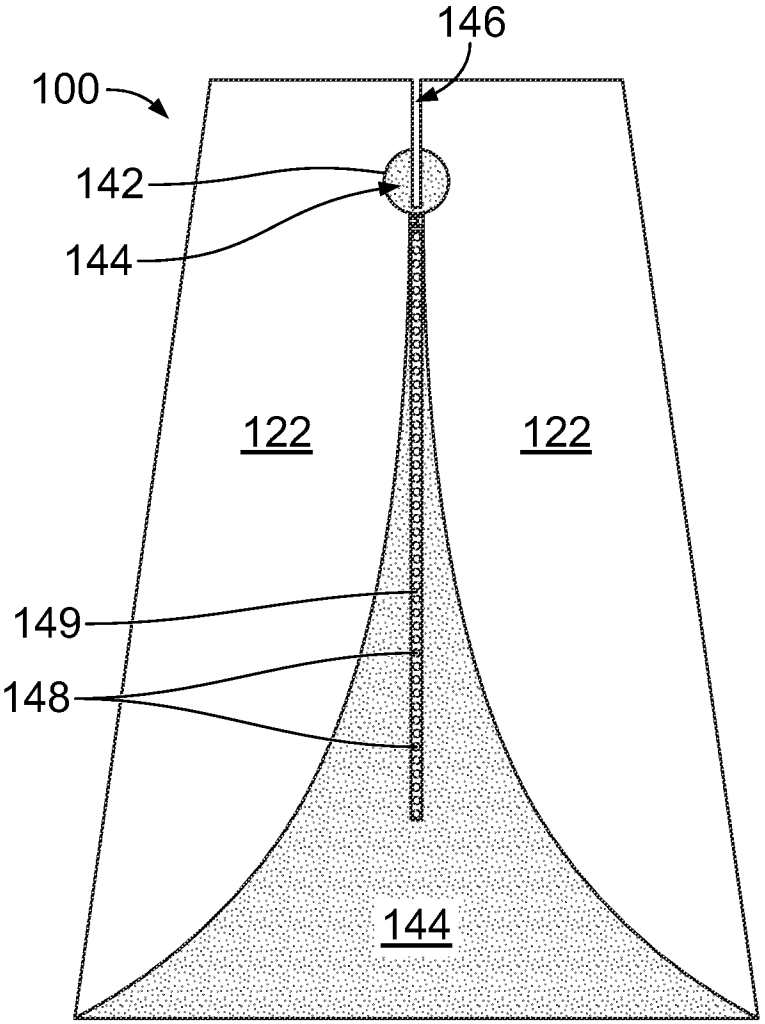
FIG. 10A is an antenna side of a first module of a dual polarized Vivaldi antenna system with a visually non-transparent non-conductive support according to disclosed embodiments.

As seen in FIGS. 9-10, in some embodiments, the first antenna module 100 can include a first non-conductive support 144. FIGS. 9A and 9B respectively show the antenna side and the feed side of the first antenna module 100 with the non-conductive support 144 being visually transparent to the electrical components. Whereas FIGS. 10A and 10B respectively show the antenna side and the feed side of the antenna module 100 with the first non-conductive support 144 being visually non-transparent to the electrical components. As seen in FIGS. 9-10, in some embodiments, the first non-conductive support 144 can be disposed between the first plane in which the first Vivaldi antenna element 122 resides and the second plane in which the first conductive strip 124 resides. In some embodiments, the first Vivaldi antenna element 122 can be coupled to a first side of the first non-conductive support 144 and the conductive strip 124 can be coupled to a second side of the first non-conductive support 144 that is opposite the first side. Furthermore, in some embodiments, the first notch 146 can pass through both the electrical components of the first antenna module 100 and the first non-conductive support 144.

Further still, in some embodiments, the plurality of through holes 148 can pass through the non-conductive support 144 so as to enable electrical connections therethrough. For example, in some embodiments the plurality of through holes 148 can include electroplated through holes and/or vias as would be understood by persons having ordinary skill in the art. As seen in FIGS. 8A, 9A, and 10A, in some embodiments, the antenna side of the first antenna module 100 can include a conductive support 149 that joins together some of the plurality of through holes 148. In some embodiments, the plurality of through holes 148 can be formed by drilling through the combined structure of the electrical components of the first antenna module 100 and the first non-conductive support 144. In some embodiments, the electrical components of the first antenna module and the first non-conductive support 144 can include separately formed through holes that can then be aligned together to form the plurality of through holes 148 when the electrical components of the first antenna module 100 are joined to the first non-conductive support 144.

In some embodiments, the first non-conductive support 144 can include a PCB. In some embodiments, the electrical components of the first antenna module 100, including the first Vivaldi antenna element 122, the conductive strip 124, and the first signal feed 136 can be integrally formed with the PCB using one or more etching procedures known in the art. For example, in some embodiments, the first antenna module 100 can be formed from a dual sided conductive material clad PCB by applying a resist material to sections corresponding to the electrical components and etching away the other portions of the conductive material to reveal the PCB layer underneath (see e.g. the first non-conductive support sections 144 in FIG. 10A and FIG. 10B).

In some embodiments, the electrical components of the first antenna module 100, including the first Vivaldi antenna element 122, the first conductive strip 124, and the first signal feed 136, can be manufactured from an electrically conductive material. For example, in some embodiments the electrical components can be made from a metallic material such as copper. In a transmitting operation, the electrical components can be energized by an electrical signal supplied to the first antenna module 100 through the first signal feed 136 and the first external connector 110 and can then radiate the supplied signal into space over a large bandwidth via the first and second radiating elements 126 and 128. Similarly, in a receiving operation, the first and second radiating elements 126 and 128 can be energized by an ambient RF signal and can route the ambient RF signal to other RF components electrically coupled to the signal feed 136 via for example the first external connector 110.

Figure 11B:
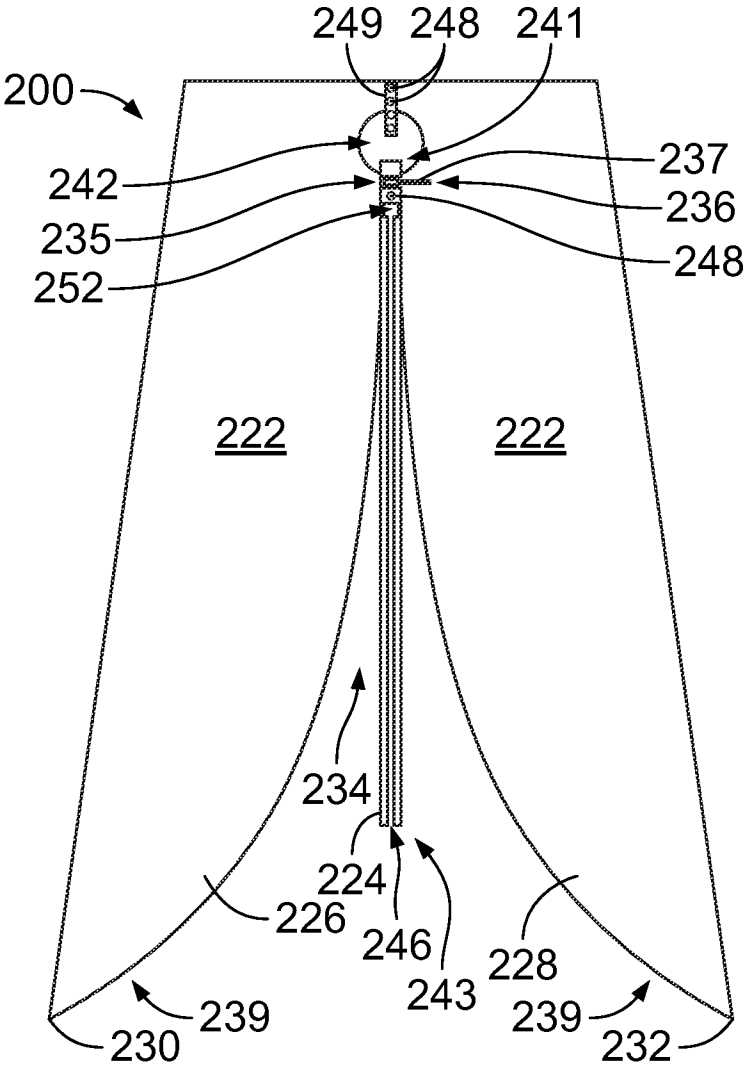
FIG. 11B is a feed side of the electrical components of a second module of a dual polarized Vivaldi antenna system according to disclosed embodiments.
Figure 11A:
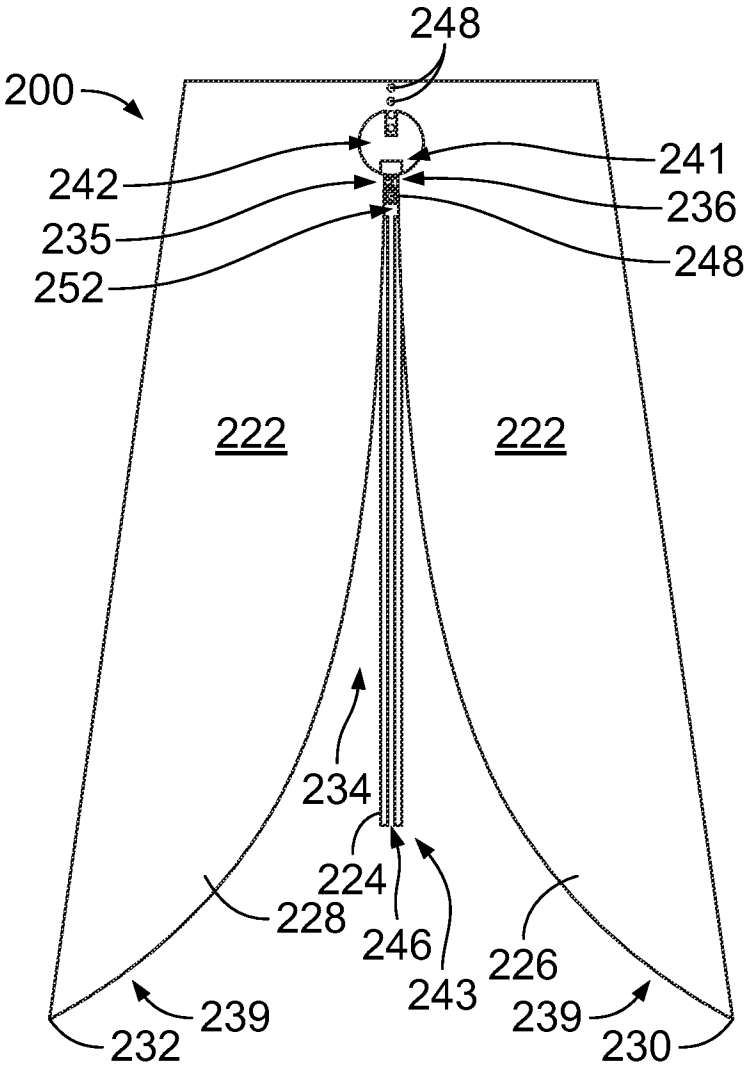
FIG. 11A is an antenna side of the electrical components of a second module of a dual polarized Vivaldi antenna system according to disclosed embodiments.

FIG. 11A is an antenna side and FIG. 11B is a feed side showing the electrical components of the second antenna module 200 according to disclosed embodiments. As seen in FIGS. 8A and 8B, the electrical components of second antenna module 200 can include at least a second Vivaldi antenna element 222 positioned in a first plane and a second conductive strip 224 positioned in a second plane offset from and parallel to the first plane. As seen in FIGS. 11A and 11B, the second Vivaldi antenna element 222 can include a third radiating element 226 and a fourth radiating element 228 each having respective distil ends 230 and 232. In some embodiments, the second Vivaldi antenna element 222 can include a second slot 234 disposed between the third and fourth radiating elements 226 and 228. In some embodiments, a longitudinal axis of the second conductive strip 224 can run parallel to a central axis of the second slot 234. Furthermore, in some embodiments, the second antenna module 200 can include a second notch 246 configured to receive a portion of the first antenna module 100. Further still, in some embodiments, the second antenna module 200 can include a plurality of through holes 248 disposed on and passing through the second Vivaldi antenna element 222 and/or the second conductive strip 224. As seen in FIG. 11A and FIG. 11B, the second antenna module 200 can also include a second signal feed 236 that can be coupled across the second slot 234 at a fifth location 235 and that, in some embodiments, can be fed by a second microstrip conductor 237 that can be coupled to the external connector 210 shown in FIG. 7. Additionally or alternatively, in some embodiments. the second signal feed 236 can be fed by a coaxial cable.

Furthermore, as seen in FIG. 11A and FIG. 11B, in some embodiments a width of the second slot 234 can increase from the fifth location 235 to a sixth location 239 spanning the respective distal ends 230 and 232 of the third and fourth radiating elements 226 and 228. In some embodiments, the width of the second slot 234 can increase at an exponential or approximately exponential rate. Furthermore, in some embodiments, a width of the second conductive strip 224 can be wider than a narrowest section of the second slot 234 and smaller than a widest section of the second slot 234. For example, as seen in FIG. 11A the second Vivaldi antenna element 222 overlaps a portion of the second conductive strip 224 at the narrow most section of the second slot 234.

Furthermore, in some embodiments, the second Vivaldi antenna element 222 can include a second cutout region 242 that can be sized and shaped to tune one or more RF characteristics of the dual polarized Vivaldi antenna system 50. As seen in FIG. 11A and FIG. 11B, in some embodiments, the fifth location 235 where the signal feed 236 is coupled across the second slot 234 can be located between the second cutout region 242 and the sixth location 239 spanning the respective distal ends 230 and 232 of the third and fourth radiating elements 226 and 228. Furthermore, in some embodiments, the second conductive strip 224 can extend in the second plane from a seventh location 241 aligned with a portion of the second cutout region 242 to an eighth location 243. In some embodiments, the eighth location 243 can be located between the fifth location 235 and the sixth location 239. However, in some embodiments, the eighth location 243 can be proximate to the sixth location 239. For example, in some embodiments, the second conductive strip 224 can extend all the way to the distal ends 230 and 232.

Figure 12B:
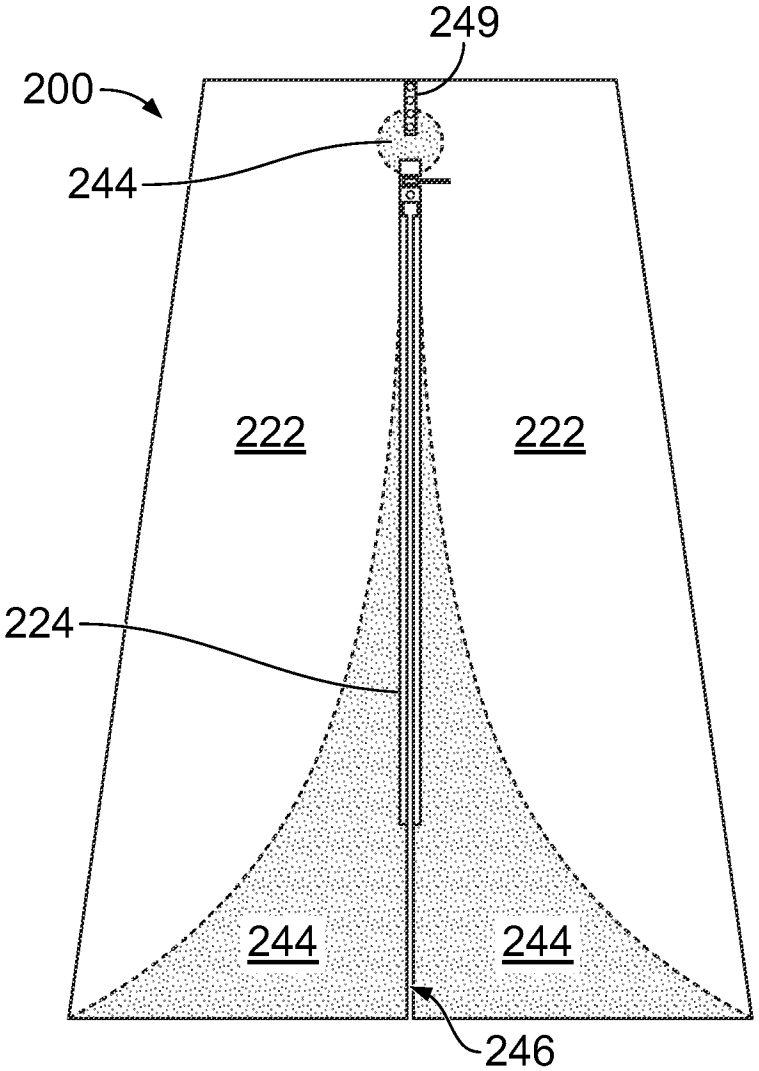
FIG. 12B is a feed side of a second module of a dual polarized Vivaldi antenna system with a visually transparent non-conductive support according to disclosed embodiments.
Figure 12A:
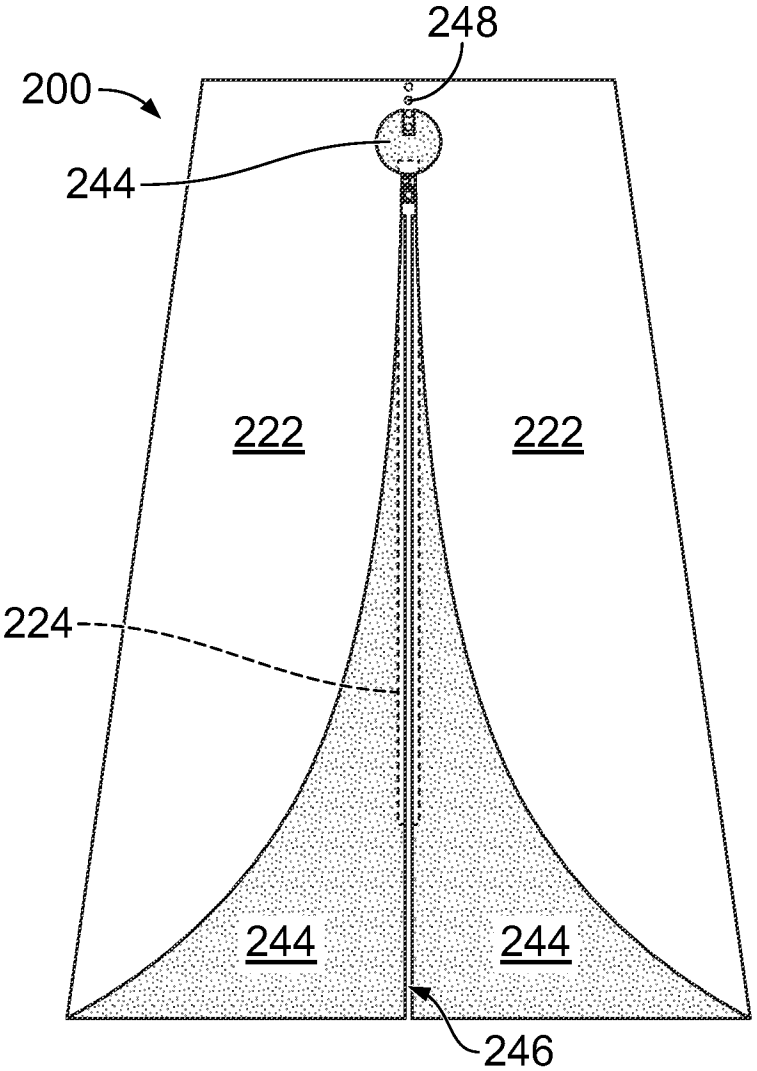
FIG. 12A is an antenna side of a second module of a dual polarized Vivaldi antenna system with a visually transparent non-conductive support according to disclosed embodiments.
Figure 13B:
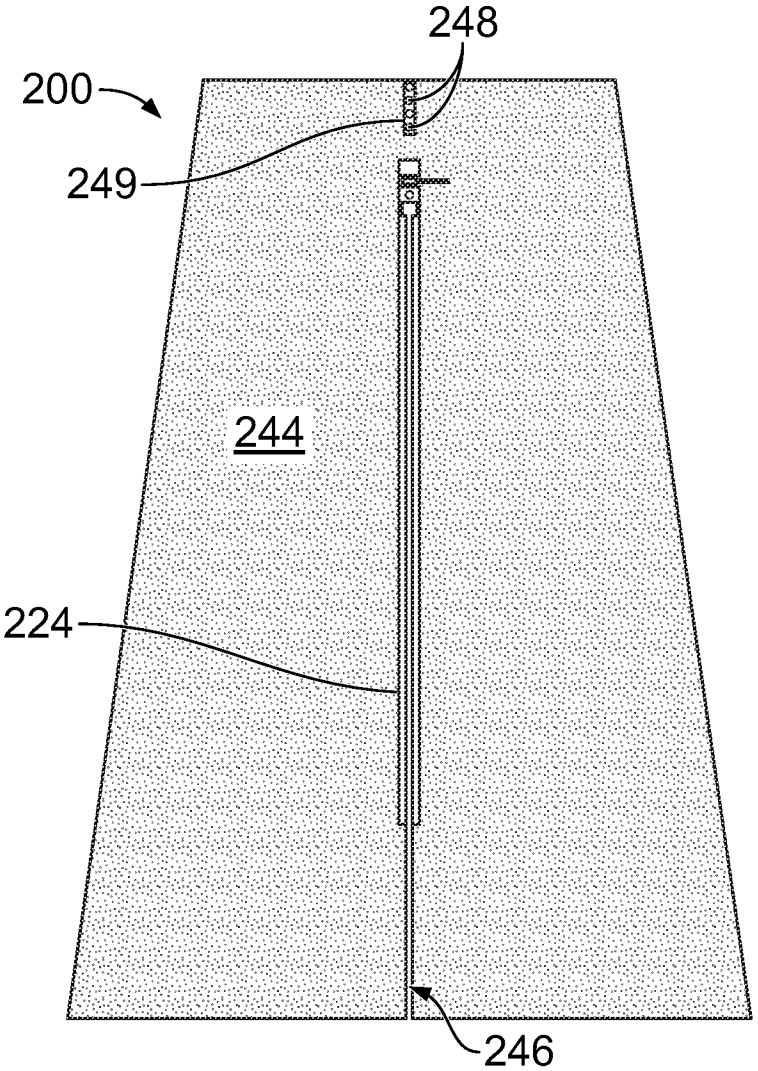
FIG. 13B is a feed side of a second module of a dual polarized Vivaldi antenna system with a visually non-transparent non-conductive support according to disclosed embodiments.
Figure 13A:
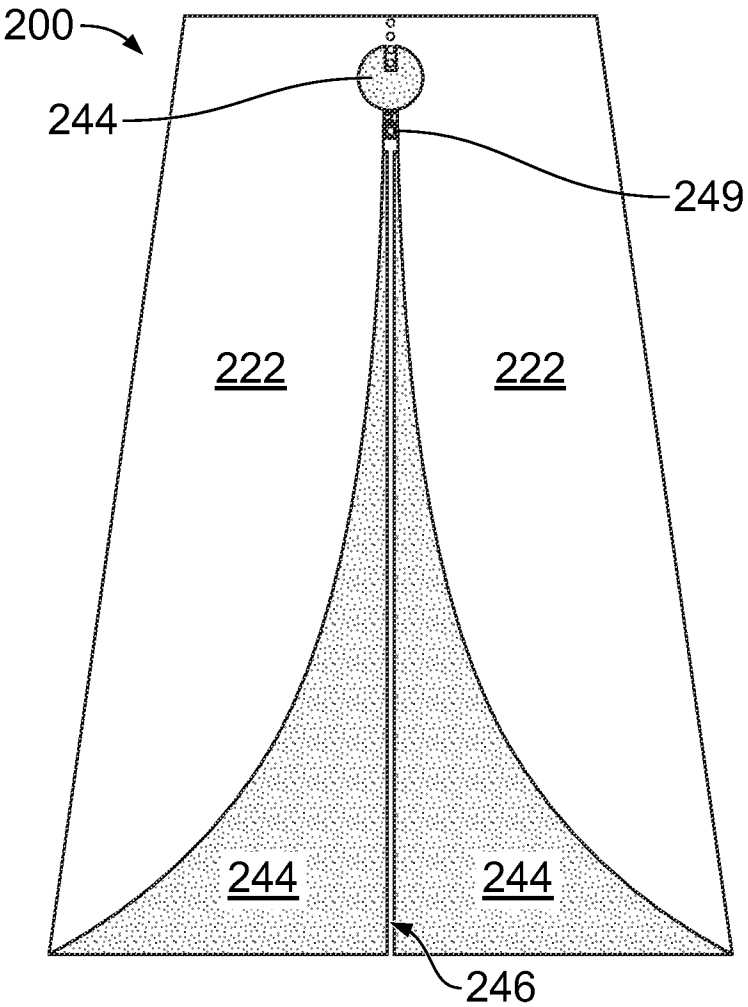
FIG. 13A is an antenna side of a second module of a dual polarized Vivaldi antenna system with a visually non-transparent non-conductive support according to disclosed embodiments.

As seen in FIGS. 12-13, in some embodiments, the second antenna module 200 can include a second non-conductive support 244. FIGS. 12A and 12B respectively show the antenna side and the feed side of the second antenna module 200 with the second non-conductive support 244 being visually transparent to the electrical components. Whereas FIGS. 13A and 13B respectively show the antenna side and the feed side of the antenna module 200 with the second non-conductive support 244 being visually non-transparent to the electrical components. As seen in FIGS. 12-13, in some embodiments, the second non-conductive support 244 can be disposed between the first plane in which the second Vivaldi antenna element 222 resides and the second plane in which the second conductive strip 224 resides. In some embodiments, the second Vivaldi antenna element 222 can be coupled to a first side of the second non-conductive support 244 and the conductive strip 224 can be coupled to a second side of the second non-conductive support 244 that is opposite the first side. Furthermore, in some embodiments, the second notch 246 can pass through both the electrical components of the second antenna module 200 and the second non-conductive support 244.

Further still, in some embodiments, the plurality of through holes 248 can pass through the non-conductive support 244 so as to enable electrical connections therethrough. For example, in some embodiments the plurality of through holes 248 can include electroplated through holes and/or vias as would be understood by persons having ordinary skill in the art. As seen in FIGS. 11-13, in some embodiments, a conductive support 249 can join together some of the plurality of through holes 248. In some embodiments, the plurality of through holes 248 can be formed by drilling through the combined structure of the electrical components of the second antenna module 200 and the second non-conductive support 244. In some embodiments, the electrical components of the second antenna module and the second non-conductive support 244 can include separately formed through holes that can then be aligned together to form the plurality of through holes 248 when the electrical components of the second antenna module 200 are joined to the second non-conductive support 244.

In some embodiments, the second non-conductive support 244 can include a PCB. In some embodiments, the electrical components of the second antenna module 200, including the second Vivaldi antenna element 222, the conductive strip 224, and the second signal feed 236 can be integrally formed with the PCB using one or more etching procedures known in the art. For example, in some embodiments, the second antenna module 200 can be formed from a dual sided conductive material clad PCB by applying a resist material to sections corresponding to the electrical components and etching away the other portions of the conductive material to reveal the PCB layer underneath (see e.g., the second non-conductive support sections 244 in FIG. 13A and FIG. 13B).

In some embodiments, the electrical components of the second antenna module 200, including the second Vivaldi antenna element 222, the second conductive strip 224, and the second signal feed 236, can be manufactured from an electrically conductive material. For example, in some embodiments the electrical components can be made from a metallic material such as copper. In a transmitting operation, the electrical components can be energized by an electrical signal supplied to the second antenna module 200 through the second signal feed 236 and the second external connector 210 (see FIG. 7) and can then radiate the supplied signal into space over a large bandwidth via the third and fourth radiating elements 226 and 228. Similarly, in a receiving operation, the third and fourth radiating elements 226 and 228 can be energized by an ambient RF signal and can route the ambient RF signal to other RF components electrically coupled to the signal feed 236 via for example the second external connector 210. In some embodiments, the different orientation of the second antenna module 200 as compared with the first antenna module 100 can result in the second antenna module 200 transmitting or receiving an RF signal with polarization different from the RF signal transmitted or received by the second antenna module 200.

As can be seen in FIG. 7, in some embodiments, the first antenna module 100 and the second antenna module 200 can be joined together to form the dual polarized antenna system 50. In some embodiments, the first notch 146 can receive a rear section of the second antenna module 200 and the second notch 246 can receive a forward section of the first antenna module 100. In some embodiments, portions of the electrical components of the first antenna module 100 and the second antenna module 200 that are bisected by the first notch 146 or the second notch 246 can be electrically coupled together through one or more of the various plurality of through holes 148 and 248. In some embodiments, the first notch 146 and the second notch 246 can have respective widths equal to approximately the respective thickness of the first and second antenna modules 100 and 200. Additionally or alternatively, in some embodiments, the first notch 146 and the second notch 246 can have respective widths equal to approximately the combined thickness of the first Vivaldi antenna element 122 and the first non-conductive support 144 or the second Vivaldi antenna element 222 and the second non-conductive support 244

Figure 14:
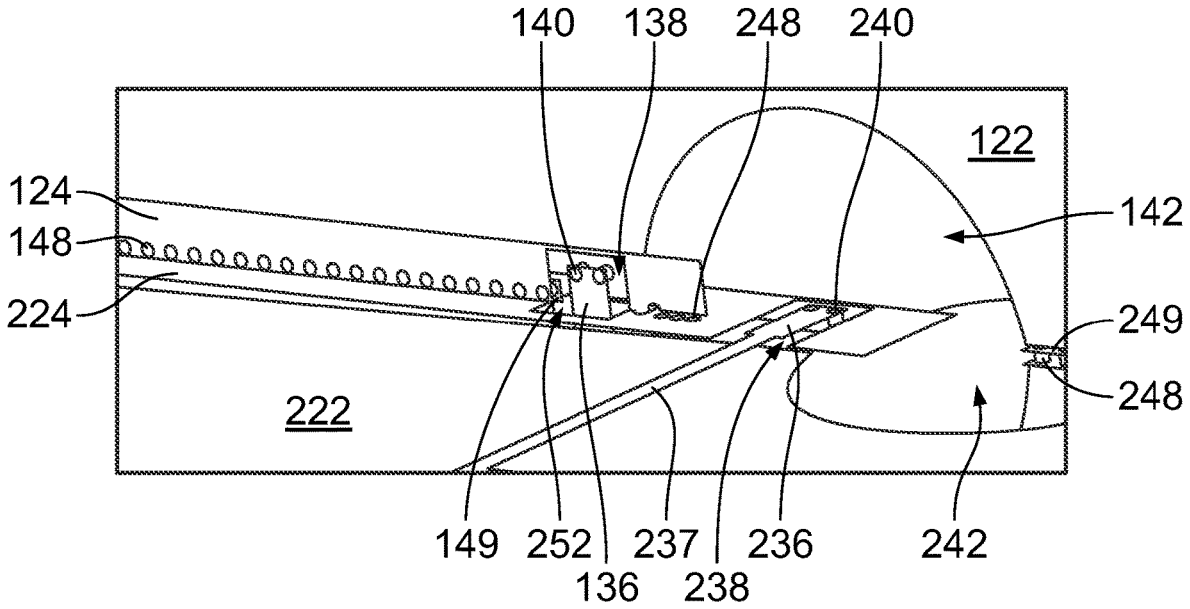
FIG. 14 is a partial perspective view of the electrical components of a dual polarized Vivaldi antenna system according to disclosed embodiments.
Figure 15:
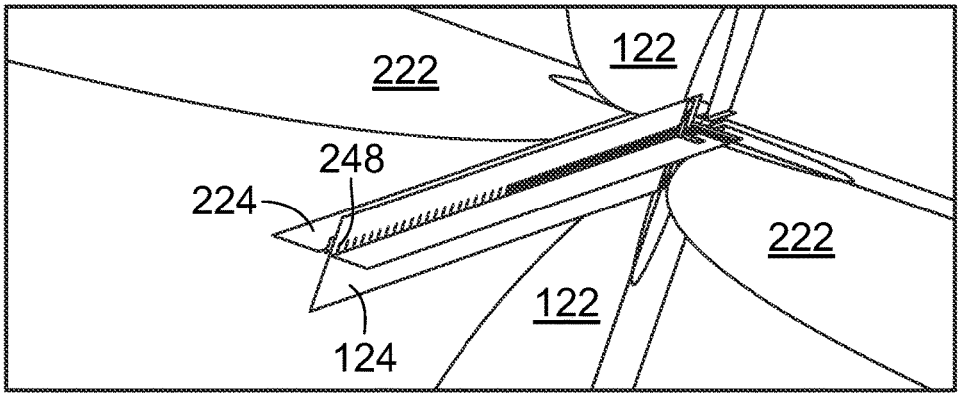
FIG. 15 is a partial perspective view of the electrical components of a dual polarized Vivaldi antenna system according to disclosed embodiments.

FIGS. 14 and 15 are partial perspective views of the electrical components of a dual polarized Vivaldi antenna system 50 with the first and second non-conductive supports 144 and 244 removed. As seen in FIGS. 14 and 15, the portions of the first Vivaldi antenna element 122 and the first conductive strip 124 that are bisected by the first notch 146 are electrically coupled together through one or more of the plurality of through holes 248. Similarly, the portions of the second conductive strip 224 that are bisected by the second notch are electrically coupled together through one or more of the plurality of through holes 148.

Furthermore, as seen in FIGS. 14 and 15, in some embodiments, a portion of the first signal feed 136 can be positioned in the same plane as the first conductive strip 124 and a portion of the second signal feed 236 can be positioned in the same plane as the second conductive strip 224. In these embodiments, the first conductive strip 124 can include a first aperture 138 configured to accommodate the portion of the first signal feed 136 that is positioned in the same plane as the first conductive strip 124. Similarly, the second conductive strip 224 can include a second aperture 238 configured to accommodate the portion of the second signal feed 236 that is positioned in the same plane as the second conductive strip 224. Furthermore, as seen in FIG. 14, in some embodiments, the second conductive strip 224 can include a third aperture 252 configured to accommodate a portion of the first signal feed 136 that passes through the plane in which the second conductive strip 224 resides. Further still, in some embodiments, the third aperture 252 can be positioned at a top of the second notch 246, can be wider than the second notch 246, and/or can pass through the second non-conductive support 244. Additionally or alternatively, in some embodiments only a portion of the third aperture 252 having a width equal to the notch 246 can pass through the second non-conductive support 244.

In some embodiments, the first signal feed 136 can be electrically coupled to the first Vivaldi antenna element 122 through electrical connections 140 and the second signal feed 236 can be electrically coupled to the second Vivaldi antenna element 222 through electrical connections 240. In some embodiments, the electrical connections 140 and 240 can pass through one or more of the plurality of through holes 148 and 248. However, in some embodiments, the electrical connections 140 and 240 can pass through additional through holes formed in the first and second antenna members 100 and 200.

Figure 16:
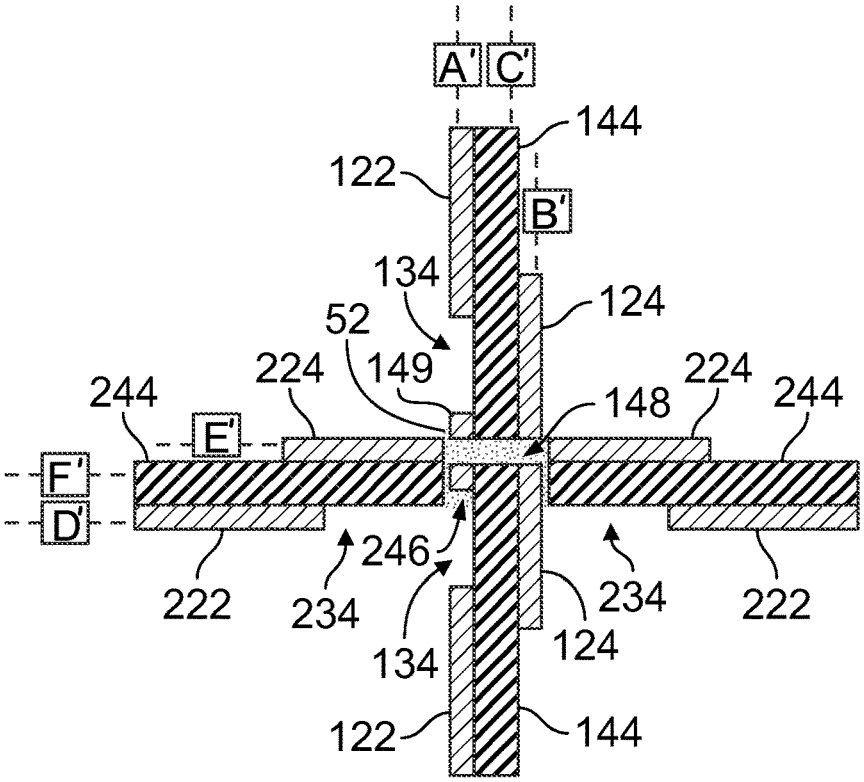
FIG. 16 is a partial cross section of a dual polarized Vivaldi antenna system according to disclosed embodiments.
Figure 17:
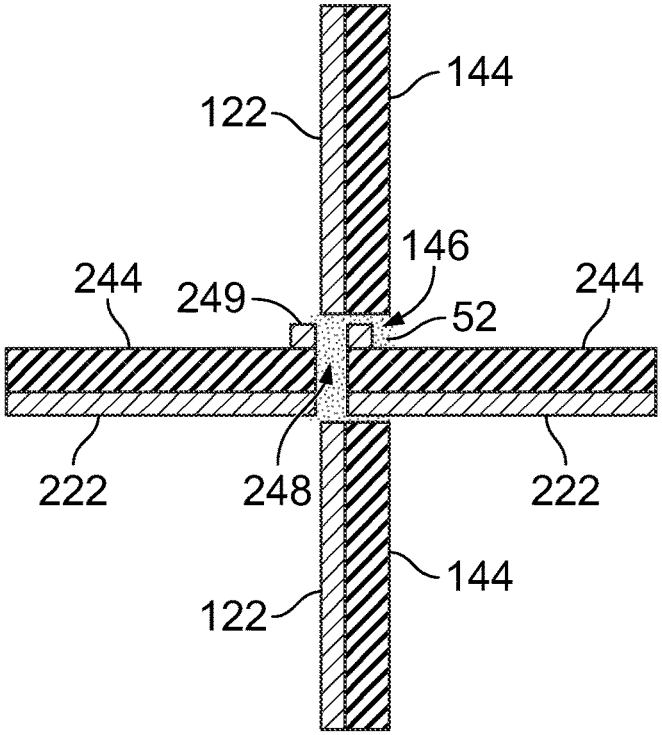
FIG. 17 is a partial cross section of a dual polarized Vivaldi antenna system according to disclosed embodiments.

The intersecting arrangement of the first antenna module 100 and the second antenna module 200 can be seen with reference to FIG. 16 and FIG. 17. First, FIG. 16 shows a partial cross section of the dual polarized Vivaldi antenna system 50 at a location crossing one of the plurality of through holes 148 and the second notch 246. Second, FIG.

17 shows a partial cross section of the dual polarized Vivaldi antenna system 50 at a location crossing one of the plurality of through holes 248 and the first notch 146. As seen in FIG. 16, in some embodiments, the first Vivaldi antenna element 122 can be positioned in in a plane A', the first conductive strip 124 can be positioned in a plane B', the first non-conductive support 144 can be positioned in a plane C' disposed between and parallel to the planes A' and B', the second Vivaldi antenna element 222 can be positioned in in a plane D', the second conductive strip 224 can be positioned in a plane E', the second non-conductive support 244 can be positioned in a plane F' disposed between and parallel to the planes D' and E'. As seen in FIG. 16 and FIG. 17, in some embodiments, the plurality of through holes 148 and 248 can be filled with an electrically conductive material 52 to facilitate respective electrical connections therethrough and, in some embodiments, to secure the first antenna module 100 together with the second antenna module 200. In some embodiments, the electrically conductive material 52 can include solder.

In some embodiments, the plurality of through holes 148 can be configured such that an electrical connection is also formed between the electrical components of the first antenna module 100 and the electrical components of the second antenna module 200, for example the first conductive strip 124 and the second conductive strip 224. However, in alternative embodiments, the plurality of through holes 148 can be configured such that an electrical connection is only formed between the electrical components of the second antenna module 200 that are bisected by the second notch 246, for example the second conductive strip 224. Similarly, in some embodiments, the plurality of through holes 248 can be configured such that an electrical connection is also formed between the electrical components of the first antenna module 100 and the electrical components of the second antenna module 200, for example the first Vivaldi antenna element 122 and the second Vivaldi antenna element 222. However, in alternative embodiments, the plurality of through holes 248 can be configured such that an electrical connection is only formed between the electrical components of the first antenna module 100 that are bisected by the first notch 146, for example the first Vivaldi antenna element 122 and portions of the first conductive strip 124.

Figure 18:
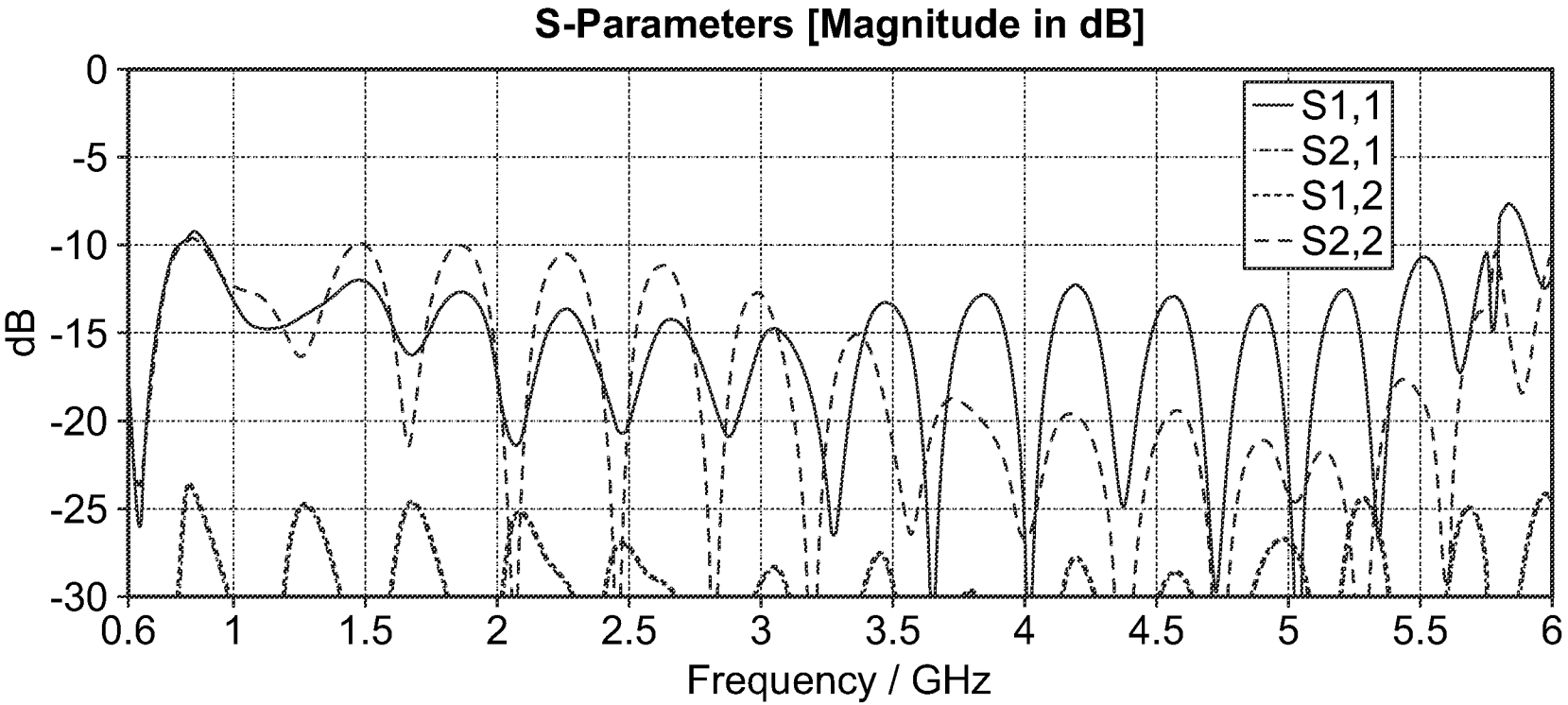
FIG. 18 is a graph of simulated reflection and transmission S-parameter magnitudes for a dual polarized Vivaldi antenna system according to disclosed embodiments.
Figure 19:
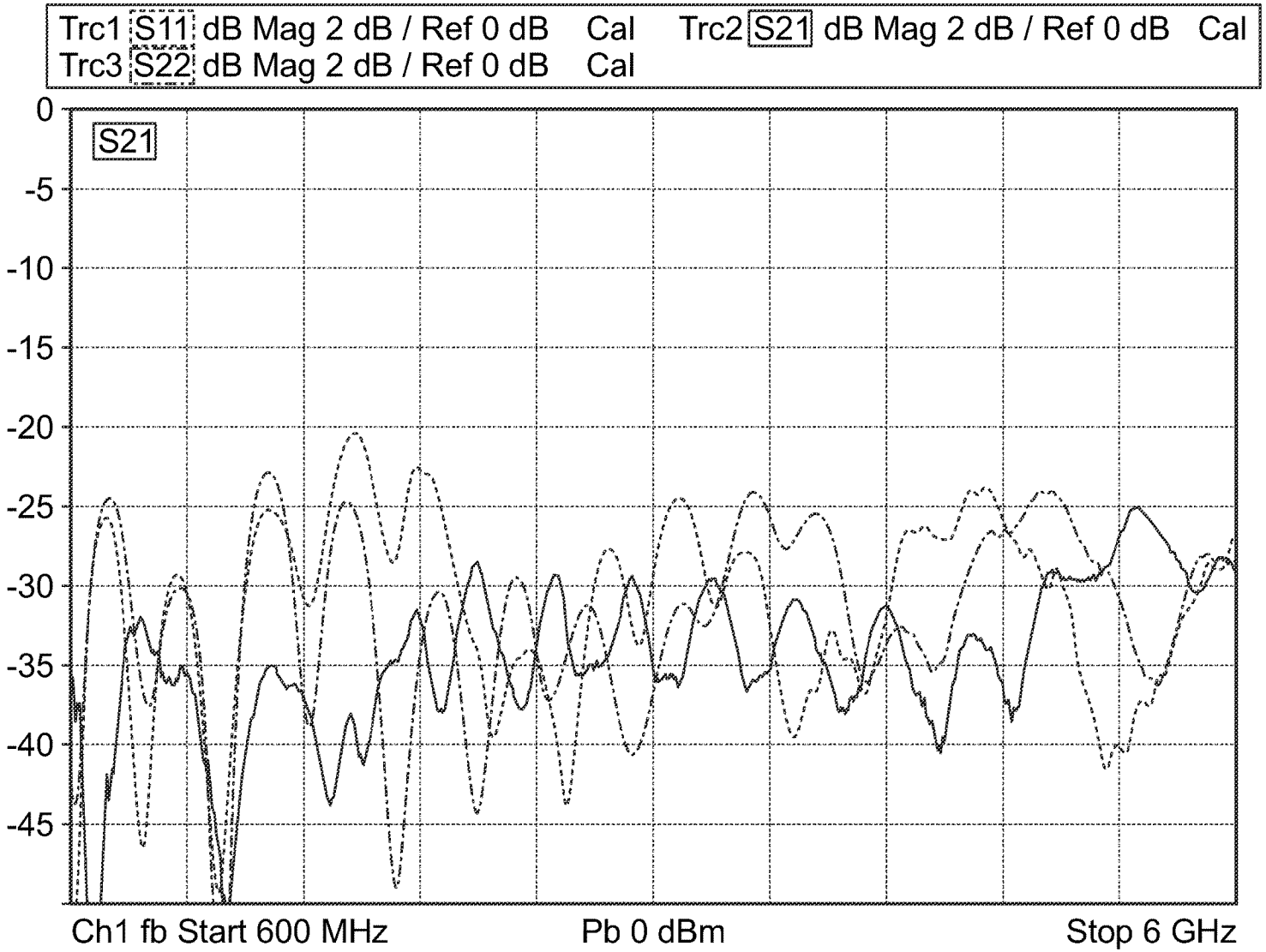
FIG. 19 is a graph of measured reflection and transmission S-parameter magnitudes for a dual polarized Vivaldi antenna system according to disclosed embodiments.

The configuration of the dual polarized Vivaldi antenna system 50 described herein has several advantages over known systems. For example, as with the single polarized Vivaldi antenna system 20 described herein, the placement of the first and second conductive strips 124 and 224 on the opposite side of the first and second non-conductive supports 144 and 244 from the first and second slots 134 and 234 can increase the capacitance between the opposing sides of the first and second slots 134 and 234 to enable the first and second Vivaldi antenna elements 122 and 222 to be made from thin layers of conductive material. Furthermore, the inclusion of the first and second conductive strips 124 and 224 enables a respective width of the first and second slots 134 and 234 to be wide enough to accommodate the intersecting first and second antenna modules 100 and 200 so as to simultaneously enable the construction of dual polarized Vivaldi antenna system 50 and a wide coverage bandwidth for the dual polarized Vivaldi antenna system 50. The resulting simulated reflection and transmission S-parameter magnitude for the dual polarized Vivaldi antenna system 50 is shown in FIG. 18 and the measured reflection and transmission S-parameter magnitude for the dual polarized Vivaldi antenna system 50 is shown in FIG. 19.

Although a few embodiments have been described in detail above, other modifications are possible. For example, other components may be added to or removed from the described systems, and other embodiments may be within the scope of the invention.

From the foregoing, it will be observed that numerous variations and modifications may be effected without departing from the spirit and scope of the invention. It is to be understood that no limitation with respect to the specific system or method described herein is intended or should be inferred. It is, of course, intended to cover all such modifications as fall within the spirit and scope of the invention.

What is claimed is:

1. An antenna system comprising:

a first Vivaldi antenna element positioned in a first plane, the first Vivaldi antenna element including first and second radiating elements and a first slot disposed between the first and second radiating elements;

a first signal feed electrically coupled across the first slot at a first location; and a first conductive strip positioned in a second plane offset from and parallel to the first plane, wherein the first conductive strip is positioned in the second plane such that the first conductive strip runs parallel to the first slot, and wherein the first Vivaldi antenna element includes a cutout region, wherein the first location is located between the cutout region and a second location spanning respective distal ends of the first and second radiating elements, and wherein the first conductive strip extends in the second plane from a third location aligned with a portion of the cutout region to a fourth location, wherein the fourth location is located between the first location and the second location or is proximate to the second location.

2. An antenna system comprising:

a first Vivaldi antenna element positioned in a first plane, the first Vivaldi antenna element including first and second radiating elements and a first slot disposed between the first and second radiating elements;

a first signal feed electrically coupled across the first slot at a first location;

a first conductive strip positioned in a second plane offset from and parallel to the first plane;

a second Vivaldi antenna element positioned in a third plane including third and fourth radiating elements and a second slot disposed between the third and fourth radiating elements;

a second signal feed electrically coupled across the second slot at a second location;

a second conductive strip positioned in a fourth plane offset from and parallel to the third plane, a first non-conductive support disposed between the first plane and the second plane; and a second non-conductive support disposed between the third plane and the fourth plane, wherein the third plane and fourth plane are perpendicular to the first plane and the second plane, wherein the first conductive strip is positioned in the second plane such that the first conductive strip runs parallel to the first slot, wherein the second conductive strip is positioned in the fourth plane such that the second conductive strip runs parallel to the second slot, wherein the first Vivaldi antenna element is coupled to one side of the first non-conductive support and the first conductive strip is coupled to an opposing side of the first non-conductive support, wherein the second Vivaldi antenna element is coupled to one side of the second non-conductive support and the second conductive strip is coupled to an opposing side of the second non-conductive support, wherein the first non-conductive support includes a first plurality of through holes and a first notch configured to receive a portion of the second non-conductive support, wherein the second non-conductive support includes a second plurality of through holes and a second notch configured to receive a portion of the first non-conductive support, wherein the first signal feed includes a portion positioned in the second plane, coupled to a same side of the first non-conductive support as the first conductive strip, and coupled to the first Vivaldi antenna element through one or more of the first plurality of through holes, wherein the second signal feed includes a portion positioned in the fourth plane, coupled to a same side of the second non-conductive support as the second conductive strip, and coupled to the second Vivaldi antenna element through one or more of the second plurality of through holes.

3. The antenna system of claim 2 wherein the first conductive strip includes a first aperture configured to accommodate the portion of the first signal feed that is positioned in the second plane and at least some of the first plurality of through holes, wherein the second conductive strip includes a second aperture configured to accommodate the portion of the second signal feed that is positioned in the fourth plane, a third aperture configured to accommodate the portion of the first signal feed that passes through the fourth plane, and at least some of the second plurality of through holes, wherein the second Vivaldi antenna element includes at least some of the second plurality of through holes, wherein portions of the first Vivaldi antenna element that are bisected by the first notch are electrically coupled together through the at least some of the second plurality of through holes included on the second Vivaldi antenna element, wherein portions of the first conductive strip that are bisected by the first notch are electrically coupled together through the at least some of the second plurality of through holes included on the second conductive strip, wherein portions of the second conductive strip that are bisected by the second notch are electrically coupled together through the at least some of the first plurality of through holes included on the first conductive strip.

4. The antenna system of claim 3 wherein the first non-conductive support and the second non-conductive support includes a respective printed circuit board.

5. The antenna system of claim 3 wherein the first Vivaldi antenna element includes a first cutout region and the second Vivaldi antenna element includes a second cutout region offset from and partially overlapping a portion of the first cutout region, wherein a portion of the second Vivaldi antenna element that includes the at least some of the second plurality of through holes protrudes into the second cutout region.

6. The antenna system of claim 3 wherein each of the first and second plurality of through holes are filled with an electrically conductive material to facilitate respective electrical connections therethrough.

7. An antenna system comprising:

a first Vivaldi antenna element positioned in a first plane, the first Vivaldi antenna element including first and second radiating elements and a first slot disposed between the first and second radiating elements;

a first signal feed electrically coupled across the first slot at a first location; and a first conductive strip positioned in a second plane offset from and parallel to the first plane, and wherein the first conductive strip is positioned in the second plane such that the first conductive strip runs parallel to the first slot, and wherein a first end of the first conductive strip is positioned proximal to the first location and a second end of the first conductive strip is positioned proximal to a distal end of the first slot away from the first location, a second Vivaldi antenna element positioned in a third plane including third and fourth radiating elements and a second slot disposed between the third and fourth radiating elements;

a second signal feed electrically coupled across the second slot at a second location; and a second conductive strip positioned in a fourth plane offset from and parallel to the third plane, wherein the third plane and fourth plane are perpendicular to the first plane and the second plane, wherein the second conductive strip is positioned in the fourth plane such that the second conductive strip runs parallel to the second slot, wherein the first Vivaldi antenna element includes a first cutout region and the second Vivaldi antenna element includes a second cutout region offset from and partially overlapping a portion of the first cutout region, wherein the first location is located between the first cutout region and a third location spanning respective distal ends of the first and second radiating elements, wherein the second location is located between the second cutout region and a fourth location spanning respective distal ends of the third and fourth radiating elements, wherein the first conductive strip extends in the second plane from a fifth location aligned with a portion of the first cutout region to a sixth location, wherein the sixth location is located between the first location and the third location or is proximate to the third location, and wherein the second conductive strip extends in the fourth plane from a seventh location aligned with a portion of the second cutout region to an eighth location, wherein the eight location is located between the second location and the fourth location or is proximate to the fourth location.

* * * * *